US009822631B2

(12) United States Patent
Ravi et al.

(10) Patent No.: US 9,822,631 B2
(45) Date of Patent: Nov. 21, 2017

(54) MONITORING DOWNHOLE PARAMETERS USING MEMS

(71) Applicant: Halliburton Energy Services, Inc., Houston, TX (US)

(72) Inventors: Krishna M. Ravi, Kingwood, TX (US); Craig W. Roddy, Duncan, OK (US); Ricky L. Covington, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 280 days.

(21) Appl. No.: 14/919,975

(22) Filed: Oct. 22, 2015

(65) Prior Publication Data

US 2016/0040524 A1 Feb. 11, 2016

Related U.S. Application Data

(63) Continuation-in-part of application No. 13/855,463, filed on Apr. 2, 2013, now Pat. No. 9,194,207, which (Continued)

(51) Int. Cl.
*E21B 47/12* (2012.01)
*E21B 47/00* (2012.01)

(Continued)

(52) U.S. Cl.
CPC ..... *E21B 47/0005* (2013.01); *E21B 33/13* (2013.01); *E21B 43/25* (2013.01); *E21B 47/01* (2013.01); *E21B 47/10* (2013.01); *E21B 47/122* (2013.01); *E21B 33/14* (2013.01)

(58) Field of Classification Search
CPC ..... E21B 47/12; E21B 47/122
See application file for complete search history.

(56) References Cited

U.S. PATENT DOCUMENTS 3,239,005 A 3/1966 Bodine, Jr.
3,930,220 A 12/1975 Shawhan (Continued)

FOREIGN PATENT DOCUMENTS

CA 2827763 A1 8/2012
EP 1830035 A1 9/2007

(Continued)

OTHER PUBLICATIONS

Office Action issued in related Canadian Application No. 2,902,590, dated Aug. 9, 2016 (4 pages).

(Continued)

*Primary Examiner* — Kenneth L Thompson
(74) *Attorney, Agent, or Firm* — Craig W. Roddy; Baker Botts L.L.P.

(57) ABSTRACT

A method for measuring parameters related to wellsite operations comprises mixing Micro-Electro-Mechanical System (MEMS) sensors with a wellbore servicing composition in surface wellbore operating equipment. The MEMS sensors are assigned a unique identified that may be used to track individual MEMS sensor as the MEMS sensors travel through the wellbore and may be used to correlate sensor measurements taken by the MEMS sensors with particular locations in the wellbore. The MEMS sensors may be active and transmit their respective identifiers and sensor data to the surface. Transmitting identifier and sensor data from a MEMS sensor to the surface wellbore operating equipment may be via one or more other MEMS sensors, downhole devices, and surface devices.

20 Claims, 7 Drawing Sheets

Related U.S. Application Data is a continuation-in-part of application No. 13/664,286, filed on Oct. 30, 2012, now Pat. No. 9,200,500, which is a continuation-in-part of application No. 12/618,067, filed on Nov. 13, 2009, now Pat. No. 8,342,242, which is a continuation-in-part of application No. 11/695,329, filed on Apr. 2, 2007, now Pat. No. 7,712,527.

(51) Int. Cl.

| | |
|---|---|
| ***E21B 33/13*** | (2006.01) |
| ***E21B 43/25*** | (2006.01) |
| ***E21B 47/01*** | (2012.01) |
| ***E21B 47/10*** | (2012.01) |
| *E21B 33/14* | (2006.01) |

(56) References Cited

U.S. PATENT DOCUMENTS

| | | | |
|---|---|---|---|
| 4,156,229 | A | 5/1979 | Shawhan |
| 4,234,344 | A | 11/1980 | Tinsley et al. |
| 4,298,970 | A | 11/1981 | Shawhan et al. |
| 4,390,975 | A | 6/1983 | Shawhan |
| 4,512,401 | A | 4/1985 | Bodine |
| 4,653,587 | A | 3/1987 | Bodine |
| 4,736,794 | A | 4/1988 | Bodine |
| 5,121,795 | A | 6/1992 | Ewert et al. |
| 5,123,487 | A | 6/1992 | Harris et al. |
| 5,127,473 | A | 7/1992 | Harris et al. |
| 5,213,161 | A | 5/1993 | King et al. |
| 5,220,960 | A | 6/1993 | Totten et al. |
| 5,281,270 | A | 1/1994 | Totten et al. |
| 5,298,069 | A | 3/1994 | King et al. |
| 5,346,012 | A | 9/1994 | Heathman et al. |
| 5,437,329 | A | 8/1995 | Brooks et al. |
| 5,524,709 | A | 6/1996 | Withers |
| 5,588,488 | A | 12/1996 | Vijn et al. |
| 5,627,749 | A | 5/1997 | Waterman et al. |
| 5,839,508 | A | 11/1998 | Tubel et al. |
| 5,991,602 | A | 11/1999 | Sturm |
| 5,995,477 | A | 11/1999 | Smith et al. |
| 6,041,861 | A | 3/2000 | Mandal et al. |
| 6,063,738 | A | 5/2000 | Chatterji et al. |
| 6,101,447 | A | 8/2000 | Poe, Jr. |
| 6,125,935 | A | 10/2000 | Shahin, Jr. |
| 6,150,601 | A | 11/2000 | Schnatzmeyer et al. |
| 6,234,257 | B1 | 5/2001 | Ciglenec et al. |
| 6,241,028 | B1 | 6/2001 | Bijleveld et al. |
| 6,244,342 | B1 | 6/2001 | Sullaway et al. |
| 6,269,685 | B1 | 8/2001 | Oden |
| 6,283,940 | B1 | 9/2001 | Mulholland |
| 6,324,904 | B1 | 12/2001 | Ishikawa et al. |
| 6,367,550 | B1 | 4/2002 | Chatterji et al. |
| 6,374,913 | B1 | 4/2002 | Robbins et al. |
| 6,429,784 | B1 | 8/2002 | Beique et al. |
| 6,434,084 | B1 | 8/2002 | Schultz |
| 6,443,288 | B1 | 9/2002 | Aronstam et al. |
| 6,457,524 | B1 | 10/2002 | Roddy |
| 6,485,560 | B1 | 11/2002 | Scherer et al. |
| 6,547,871 | B2 | 4/2003 | Chatterji et al. |
| 6,597,175 | B1 | 7/2003 | Brisco |
| 6,664,215 | B1 | 12/2003 | Tomlinson |
| 6,693,554 | B2 | 2/2004 | Beique et al. |
| 6,697,738 | B2 | 2/2004 | Ravi et al. |
| 6,702,044 | B2 | 3/2004 | Reddy et al. |
| 6,712,138 | B2 | 3/2004 | Mandal |
| 6,722,433 | B2 | 4/2004 | Brothers et al. |
| 6,722,434 | B2 | 4/2004 | Reddy et al. |
| 6,735,630 | B1 | 5/2004 | Gelvin et al. |
| 6,745,833 | B2 | 6/2004 | Aronstam et al. |
| 6,766,141 | B1 | 7/2004 | Briles et al. |
| 6,775,578 | B2 | 8/2004 | Couet et al. |
| 6,789,619 | B2 | 9/2004 | Carlson et al. |
| 6,802,373 | B2 | 10/2004 | Dillenbeck et al. |
| 6,802,374 | B2 | 10/2004 | Edgar et al. |
| 6,817,412 | B2 | 11/2004 | Haase |
| 6,823,271 | B1 | 11/2004 | Foss |
| 6,834,722 | B2 | 12/2004 | Vacik et al. |
| 6,839,000 | B2 | 1/2005 | Das et al. |
| 6,847,034 | B2 | 1/2005 | Shah et al. |
| 6,848,519 | B2 | 2/2005 | Reddy et al. |
| 6,891,477 | B2 | 5/2005 | Aronstam |
| 6,898,529 | B2 | 5/2005 | Gao et al. |
| 6,904,366 | B2 | 6/2005 | Patzek et al. |
| 6,915,848 | B2 | 7/2005 | Thomeer et al. |
| 6,920,929 | B2 | 7/2005 | Bour |
| 6,922,637 | B2 | 7/2005 | Ravi et al. |
| 6,925,392 | B2 | 8/2005 | McNeil, III et al. |
| 6,976,535 | B2 | 12/2005 | Aronstam et al. |
| 6,994,167 | B2 | 2/2006 | Ramos et al. |
| 6,995,677 | B2 | 2/2006 | Aronstam et al. |
| 7,003,405 | B1 | 2/2006 | Ho |
| 7,004,021 | B2 | 2/2006 | Bilby et al. |
| 7,036,363 | B2 | 5/2006 | Yogeswaren |
| 7,036,586 | B2 | 5/2006 | Roddy et al. |
| 7,038,470 | B1 | 5/2006 | Johnson |
| 7,040,404 | B2 | 5/2006 | Brothers et al. |
| 7,044,222 | B2 | 5/2006 | Tomlinson |
| 7,046,164 | B2 | 5/2006 | Gao et al. |
| 7,066,256 | B2 | 6/2006 | Dillenbeck et al. |
| 7,066,284 | B2 | 6/2006 | Wylie et al. |
| 7,077,203 | B1 | 7/2006 | Roddy et al. |
| 7,082,993 | B2 | 8/2006 | Ayoub et al. |
| 7,104,116 | B2 | 9/2006 | Discenzo |
| 7,107,154 | B2 | 9/2006 | Ward |
| 7,116,542 | B2 | 10/2006 | Lerche et al. |
| 7,133,778 | B2 | 11/2006 | Ravi et al. |
| 7,140,434 | B2 | 11/2006 | Chouzenoux et al. |
| 7,140,437 | B2 | 11/2006 | McMechan et al. |
| 7,145,473 | B2 | 12/2006 | Wisler et al. |
| 7,152,466 | B2 | 12/2006 | Ramakrishnan et al. |
| 7,156,174 | B2 | 1/2007 | Roddy et al. |
| 7,159,653 | B2 | 1/2007 | Vold |
| 7,174,962 | B1 | 2/2007 | Roddy et al. |
| 7,213,647 | B2 | 5/2007 | Brothers et al. |
| 7,225,879 | B2 | 6/2007 | Wylie et al. |
| 7,303,014 | B2 | 12/2007 | Reddy et al. |
| 7,357,181 | B2 | 4/2008 | Webb et al. |
| 7,389,819 | B2 | 6/2008 | Oyeneyin et al. |
| 7,392,697 | B2 | 7/2008 | Chikenji et al. |
| 7,400,262 | B2 | 7/2008 | Chemali et al. |
| 7,434,457 | B2 | 10/2008 | Goodwin et al. |
| 7,453,768 | B2 | 11/2008 | Hall et al. |
| 7,455,108 | B2 | 11/2008 | Jenkins et al. |
| 7,461,547 | B2 | 12/2008 | Terabayashi et al. |
| 7,482,309 | B2 | 1/2009 | Ravi et al. |
| 7,493,962 | B2 | 2/2009 | Sheffield |
| 7,543,642 | B2 | 6/2009 | Reddy et al. |
| 7,581,434 | B1 | 9/2009 | Discenzo et al. |
| 7,617,879 | B2 | 11/2009 | Anderson et al. |
| 7,631,697 | B2 | 12/2009 | Bhavsar |
| 7,636,671 | B2 | 12/2009 | Caveny et al. |
| 7,647,979 | B2 | 1/2010 | Shipley et al. |
| 7,673,679 | B2 | 3/2010 | Harrison et al. |
| 7,712,527 | B2 | 5/2010 | Roddy |
| 7,717,180 | B2 | 5/2010 | Badalamenti et al. |
| 7,749,942 | B2 | 7/2010 | Ravi et al. |
| 7,750,808 | B2 | 7/2010 | Masino et al. |
| 7,784,339 | B2 | 8/2010 | Cook et al. |
| 7,832,263 | B2 | 11/2010 | Rensel et al. |
| 7,866,393 | B2 | 1/2011 | Badalamenti et al. |
| 7,875,455 | B1 | 1/2011 | Li et al. |
| 7,878,245 | B2 | 2/2011 | Ravi et al. |
| 7,986,218 | B2 | 7/2011 | Watters et al. |
| 7,991,680 | B2 | 8/2011 | Livesay et al. |
| 8,083,849 | B2 | 12/2011 | Lewis et al. |
| 8,162,050 | B2 | 4/2012 | Roddy et al. |
| 8,162,055 | B2 | 4/2012 | Lewis et al. |
| 8,168,570 | B2 | 5/2012 | Barron et al. |
| 8,202,824 | B2 | 6/2012 | Reddy et al. |
| 8,269,648 | B2 | 9/2012 | Benischek et al. |
| 8,279,713 | B2 | 10/2012 | Mickael et al. |
| 8,291,975 | B2 | 10/2012 | Roddy et al. |

(56) References Cited

U.S. PATENT DOCUMENTS

| | | | | |
|---|---|---|---|---|
| 8,297,352 | B2 | 10/2012 | Roddy et al. | |
| 8,297,353 | B2 | 10/2012 | Roddy et al. | |
| 8,302,686 | B2 | 11/2012 | Roddy et al. | |
| 8,316,936 | B2 | 11/2012 | Roddy et al. | |
| 8,318,099 | B2 | 11/2012 | Potyrailo et al. | |
| 8,342,242 | B2 | 1/2013 | Roddy et al. | |
| 8,436,743 | B2 | 5/2013 | Auzerais et al. | |
| 9,194,207 | B2 * | 11/2015 | Roddy | E21B 47/01 |
| 9,200,500 | B2 * | 12/2015 | Roddy | E21B 33/13 |
| 9,394,756 | B2 * | 7/2016 | Roberson | E21B 33/13 |
| 9,394,784 | B2 * | 7/2016 | Roberson | E21B 33/13 |
| 9,394,785 | B2 * | 7/2016 | Goodwin | E21B 33/13 |
| 2002/0196993 | A1 | 12/2002 | Schroeder | |
| 2003/0029611 | A1 | 2/2003 | Owens | |
| 2003/0205376 | A1 | 11/2003 | Ayoub et al. | |
| 2005/0006020 | A1 | 1/2005 | Zitha et al. | |
| 2005/0159494 | A1 | 7/2005 | Dobbs | |
| 2005/0224123 | A1 | 10/2005 | Baynham et al. | |
| 2006/0013065 | A1 | 1/2006 | Varsamis et al. | |
| 2006/0018190 | A1 | 1/2006 | Brooks | |
| 2006/0086503 | A1 | 4/2006 | Reddy et al. | |
| 2007/0125163 | A1 | 6/2007 | Dria et al. | |
| 2007/0131414 | A1 | 6/2007 | Calderoni et al. | |
| 2008/0007421 | A1 | 1/2008 | Liu et al. | |
| 2008/0196889 | A1 | 8/2008 | Bour et al. | |
| 2008/0316049 | A1 | 12/2008 | Verret et al. | |
| 2009/0033516 | A1 | 2/2009 | Alteirac et al. | |
| 2009/0120168 | A1 | 5/2009 | Harrison et al. | |
| 2010/0039898 | A1 | 2/2010 | Gardner et al. | |
| 2010/0139386 | A1 | 6/2010 | Taylor | |
| 2010/0212891 | A1 | 8/2010 | Stewart et al. | |
| 2011/0187556 | A1 | 8/2011 | Roddy et al. | |
| 2011/0192597 | A1 | 8/2011 | Roddy et al. | |
| 2011/0199228 | A1 | 8/2011 | Roddy et al. | |
| 2011/0315377 | A1 | 12/2011 | Rioufol | |
| 2012/0055669 | A1 | 3/2012 | Levin et al. | |
| 2013/0062068 | A1 | 3/2013 | Roddy et al. | |
| 2016/0040524 | A1 * | 2/2016 | Ravi | E21B 33/13 166/253.1 |

FOREIGN PATENT DOCUMENTS

| | | | |
|---|---|---|---|
| EP | 2129867 | A0 | 10/2008 |
| EP | 2336487 | A1 | 6/2011 |
| EP | 2343434 | A1 | 7/2011 |
| EP | 2489828 | A1 | 8/2012 |
| EP | 2489829 | A1 | 8/2012 |
| GB | 2367133 | A | 3/2002 |
| GB | 2391565 | A | 2/2004 |
| GB | 2431400 | A | 4/2007 |
| NO | 2015054432 | A1 | 4/2015 |
| WO | 9966172 | A1 | 12/1999 |
| WO | 0206628 | A1 | 1/2002 |
| WO | 2006136635 | A2 | 12/2006 |
| WO | 2006136635 | A3 | 12/2006 |
| WO | 2007034273 | A1 | 3/2007 |
| WO | 2008119963 | A1 | 10/2008 |
| WO | 2009008735 | A1 | 1/2009 |
| WO | 2011023938 | A1 | 3/2011 |
| WO | 2011023938 | A9 | 3/2011 |
| WO | 2011023942 | A2 | 3/2011 |
| WO | 2011023942 | A3 | 3/2011 |
| WO | 2011058324 | A1 | 5/2011 |
| WO | 2012114068 | A2 | 8/2012 |
| WO | 2012114068 | A3 | 8/2012 |

OTHER PUBLICATIONS

Examination Report issued in GB application No. 1205236.1, dated Mar. 8, 2016 (2 pages).

International Search Report and Written Opinion issued in related PCT Application No. PCT/US2016/052698, dated Jan. 5, 2017 (18 pages).

Foreign communication from a related counterpart application—International Search Report and Written Opinion, PCT/US2013/061611, dated Sep. 10, 2014, 9 pages.

Advanced Design Consulting USA brochure entitled "MEMS concrete monitoring system," http://www.adc9001.com/index//php?src=memsconcrete&print=1, 2006, 1 page, Advanced Design Consulting USA, Inc.

Drumheller, D.S., "An overview of acoustic telemetry," 7 pages.

Foreign communication from a related counterpart application—International Search Report and Written Opinion, PCT/GB2008/001084, dated Jul. 8, 2008, 10 pages.

Foreign communication from a related counterpart application—Examination Report, European patent application No. 08718914.8, dated May 4, 2010 (5 pages).

Halliburton brochure entitled "Spherelite (TM) cement additive," Nov. 2006, 1 page, Halliburton.

International Road Dynamics brochure entitled "Concrete maturity monitor: wireless technology in the palm of your hand," Jun. 2002, 5 pages, International Road Dynamics Inc.

Nasa, "Ultrasonic testing of aerospace materials, " Preferred Reliability Practices, Practice No. PT-TE-1422, 6 pages.

Ong, Keat Ghee, et al., "A wireless, passive carbon nanotube-based gas senser," IEEE Sensors Journal, Apr. 2002, pp. 82-88, vol. 2, No. 2, IEEE.

Ong, K.G., et al., "Design and application of a wireless, passive, resonant-circuit environmental monitoring sensor," Sensors and Actuators A, 2001, pp. 33-43, vol. 93, Elsevier Science B.V.

Ravi, Kirs, et al., "Cementing process optimized to achieve zonal isolation," Petrotech, 2007, 6 pages, Halliburton.

Foreign communication from a related counterpart application—International Search Report and Written Opinion, PCT/GB2010/001580, Apr. 21, 2011, 10 pages.

Foreign communication from a related counterpart application—International Search Report and Written Opinion, PCT/GB2010/001590, dated Apr. 21, 2011, 10 pages.

Foreign communication from a related counterpart application—International Search Report and Written Opinion, PCT/GB2010/002089, dated Apr. 21, 2011, 10 pages.

Foreign communication from a related counterpart application—European Search Report, European patent application No. 11159483.4, dated May 5, 2011, 4 pages.

Foreign communication from a related counterpart application—European Search Report, European patent application No. 11159484.2, dated May 6, 2011, 4 pages.

Foreign communication from a related counterpart application—European Patent Office communication, European patent application No. 08718914.8, dated May 31, 2011, 4 pages.

Foreign communication from a related counterpart application—European Search Report, European patent application No. 12167946.8, dated Jul. 6, 2012, 6 pages.

Foreign communication from a related counterpart application—Notification of European Publication No. And Information on the Application of Article 67(3) EPC, European patent application No. 12167947.6, Jul. 25, 2012, 2 pages.

Foreign communication from a related counterpart application—Communication Pursuant to Rule 69 EPC, European patent application No. 12167947.6, dated Aug. 27, 2012, 2 pages.

Foreign communication from a related counterpart application—Supplementary European Search Report, European patent application No. 12167947.6, dated Jul. 6, 2012, 6 pages.

Foreign communication from a related counterpart application—European Patent Office communication, European patent application No. 11159483.4, dated Jul. 16, 2012, 4 pages.

Foreign communication from a related counterpart application—International Preliminary Report on Patentability, PCT/GB2008/001084, dated Oct. 6, 2009, 7 pages.

Foreign communication from a related counterpart application—International Preliminary Report on Patentability, PCT/GB2008/001580, dated Feb. 28, 2012, 6 pages.

Foreign communication from a related counterpart application—International Preliminary Report on Patentability, PCT/GB2010/001590, dated Feb. 28, 2012, 6 pages.

(56) References Cited

OTHER PUBLICATIONS

Foreign communication from a related counterpart application—International Preliminary Report on Patentability, PCT/GB2010/002089, dated May 15, 2012, 6 pages.
Foreign communication from a related counterpart application—International Search Report and Written Opinion, PCT/GB2008/000179, dated Jun. 24, 2013, 12 pages.
Office Action dated Jan. 15, 2014 (90 pages), U.S. Appl. No. 13/031,515, filed Feb. 21, 2011.
Filing receipt and specification for International application entitled "Use of Sensors Coated with Elastomer for Subterranean Operations," filed Sep. 25, 2013 as International application No. PCT/US2013/061611.
Foreign communication from a related counterpart application—Examination Report, European Patent Application No. 11159483.4, dated Sep. 13, 2013, 4 pages.
Foreign communication from a related counterpart application—Examination Report, European Patent Application No. 12167946.8, dated Sep. 20, 2013, 4 pages.
Office Action dated Aug. 5, 2014 (41 pages), U.S. Appl. No. 13/031,519, filed Feb. 21, 2011.
Office Action dated Jun. 27, 2014 (59 pages), U.S. Appl. No. 13/031,515, filed Feb. 21, 2011.
Foreign communication from a related counterpart application—International Preliminary Report on Patentability, PCT/GB2012/000179, dated Aug. 21, 2013, 8 pages.
Office Action dated Jan. 29, 2014 (79 pages), U.S. Appl. No. 13/031,519, filed Feb. 21, 2011.
Foreign communication from a related counterpart application—International Search Report and Written Opinion, PCT/US2014/030286, dated Oct. 10, 2014, 8 pages.

* cited by examiner

MONITORING DOWNHOLE PARAMETERS USING MEMS

CROSS-REFERENCE TO RELATED APPLICATIONS

This is a Continuation-in-Part application of U.S. patent application Ser. No. 13/855,463, filed Apr. 2, 2013, entitled "Surface Wellbore Operating Equipment Utilizing MEMS Sensors", which is a Continuation-in-Part application of U.S. patent application Ser. No. 13/664,286, filed Oct. 30, 2012, and entitled "Use of Sensors Coated with Elastomer for Subterranean Operations," which is a continuation-in-part of U.S. patent application Ser. No. 12/618,067, filed Nov. 13, 2009, now U.S. Pat. No. 8,342,242 issued Jan. 1, 2013, and entitled "Use of Micro-Electro-Mechanical Systems (MEMS) in Well Treatments," which is a Continuation-in-Part application of U.S. patent application Ser. No. 11/695,329 filed Apr. 2, 2007, now U.S. Pat. No. 7,712,527 issued May 11, 2010, and entitled "Use of Micro-Electro-Mechanical Systems (MEMS) in Well Treatments," each of which is hereby incorporated by reference herein in its entirety.

BACKGROUND OF THE INVENTION

This disclosure relates to the field of drilling, completing, servicing, and treating a subterranean well such as a hydrocarbon recovery well. In particular, the present disclosure relates to methods for detecting and/or monitoring the position and/or condition of wellbore servicing compositions, for example wellbore sealants such as cement, using data sensors (for example, MEMS-based sensors) coated with an elastomer. Still more particularly, the present disclosure describes methods of monitoring the integrity and performance of wellbore servicing compositions over the life of the well using data sensors (for example, MEMS-based sensors) coated with an elastomer. Additionally, the present disclosure describes methods of monitoring conditions and/or parameters of wellbore servicing compositions during wellbore operations at the surface of a wellsite and before placement into the wellbore.

Natural resources such as gas, oil, and water residing in a subterranean formation or zone are usually recovered by drilling a wellbore into the subterranean formation while circulating a drilling fluid in the wellbore. After terminating the circulation of the drilling fluid, a string of pipe (e.g., casing) is run in the wellbore. The drilling fluid is then usually circulated downward through the interior of the pipe and upward through the annulus, which is located between the exterior of the pipe and the walls of the wellbore. Next, primary cementing is typically performed whereby a cement slurry is placed in the annulus and permitted to set into a hard mass (i.e., sheath) to thereby attach the string of pipe to the walls of the wellbore and seal the annulus. Subsequent secondary cementing operations may also be performed. One example of a secondary cementing operation is squeeze cementing whereby a cement slurry is employed to plug and seal off undesirable flow passages in the cement sheath and/or the casing. Non-cementitious sealants are also utilized in preparing a wellbore. For example, polymer, resin, or latex-based sealants may be desirable for placement behind casing.

To enhance the life of the well and minimize costs, sealant slurries are chosen based on calculated stresses and characteristics of the formation to be serviced. Suitable sealants are selected based on the conditions that are expected to be encountered during the sealant service life. Once a sealant is chosen, it is desirable to monitor and/or evaluate the health of the sealant so that timely maintenance can be performed and the service life maximized. The integrity of sealant can be adversely affected by conditions in the well. For example, cracks in cement may allow water influx while acid conditions may degrade cement. The initial strength and the service life of cement can be significantly affected by its moisture content from the time that it is placed. Moisture and temperature are the primary drivers for the hydration of many cements and are critical factors in the most prevalent deteriorative processes, including damage due to freezing and thawing, alkali-aggregate reaction, sulfate attack and delayed Ettringite (hexacalcium aluminate trisulfate) formation. Thus, it is desirable to measure one or more sealant parameters (e.g., moisture content, temperature, pH and ion concentration) in order to monitor sealant integrity.

Active, embeddable sensors can involve drawbacks that make them undesirable for use in a wellbore environment. For example, low-powered (e.g., nanowatt) electronic moisture sensors are available, but have inherent limitations when embedded within cement. The highly alkali environment can damage their electronics, and they are sensitive to electromagnetic noise. Additionally, power must be provided from an internal battery to activate the sensor and transmit data, which increases sensor size and decreases useful life of the sensor. Accordingly, an ongoing need exists for improved methods of monitoring wellbore servicing compositions, for example a sealant condition.

SUMMARY OF SOME OF THE EMBODIMENTS

Disclosed herein is a method comprising mixing a wellbore servicing composition comprising Micro-Electro-Mechanical System (MEMS) sensors m surface wellbore operating equipment at the surface of a wellsite.

Further disclosed herein a wellbore servicing system comprising surface wellbore operating equipment placed at a surface of a wellsite, a wellbore servicing composition comprising a plurality of Micro-Electro-Mechanical System (MEMS) sensors, wherein the wellbore servicing composition is located within the surface wellbore operating equipment, and an interrogator placed in communicative proximity with one or more of the plurality of MEMS sensors, wherein the interrogator activates and receives data from the one or more of the plurality of MEMS sensors in the wellbore servicing composition at the surface of the wellsite.

Further disclosed herein is a method comprising placing a wellbore servicing composition comprising a Micro-Electro-Mechanical System (MEMS) sensor m a wellbore and/or subterranean formation, wherein the sensor is coated with an elastomer. The elastomer-coated sensor is configured and operable to detect one or more parameters, including a compression or swelling of the elastomer, an expansion of the elastomer, or a change in density of the composition.

Also disclosed herein is a method comprising placing a Micro-Electro-Mechanical System (MEMS) sensor in a wellbore and/or subterranean formation, placing a wellbore servicing composition in the wellbore and/or subterranean formation, and using the MEMS sensor to detect a location of the wellbore servicing composition, wherein the sensor is coated with an elastomer.

Also disclosed herein is a method comprising placing a Micro-Electro-Mechanical System (MEMS) sensor in a wellbore and/or subterranean formation, placing a wellbore servicing composition in the wellbore and/or subterranean formation, and using the MEMS sensor to monitor a condition of the wellbore servicing composition, wherein the sensor is coated with an elastomer.

Further disclosed herein is a method comprising placing one or more Micro-Electro-Mechanical System (MEMS) sensors in a wellbore and/or subterranean formation, placing a wellbore servicing composition in the subterranean formation, using the one or more MEMS sensors to detect a location of at least a portion of the wellbore servicing composition, and using the one or more MEMS sensors to monitor at least a portion of the wellbore servicing composition, wherein the one or more sensors are coated with an elastomer.

Further disclosed herein is a method comprising placing one or more Micro-Electro-Mechanical System (MEMS) sensors in a wellbore and/or subterranean formation using a wellbore servicing composition, and monitoring a condition using the one or more MEMS sensors, wherein the one or more sensors are coated with an elastomer.

Further disclosed herein is a method comprising placing one or more Micro-Electro-Mechanical System (MEMS) sensors in a wellbore and/or subterranean formation using a wellbore servicing composition, wherein the one or more MEMS sensors comprise an amount from about 0.001 to about 10 weight percent of the wellbore servicing composition, wherein the one or more sensors are coated with an elastomer.

Further disclosed herein is a method comprising placing one or more Micro-Electro-Mechanical System (MEMS) sensors in $C0_2$ injection, storage or disposal well in a subterranean formation, and monitoring a condition using the one or more MEMS sensors, wherein the one or more sensors are coated with an elastomer.

Further disclosed herein is a method comprising placing a wellbore servicing composition comprising a plurality of elastomer-coated sensors in a wellbore, a subterranean formation, or both.

Further disclosed herein is a wellbore servicing composition comprising a base fluid and a plurality of elastomer-coated sensors.

The foregoing has outlined rather broadly the features and technical advantages of the present disclosure in order that the detailed description that follows may be better understood. Additional features and advantages of the apparatus and method will be described hereinafter that form the subject of the claims of this disclosure. It should be appreciated by those skilled in the art that the conception and the specific embodiments disclosed may be readily utilized as a basis for modifying or designing other structures for carrying out the same purposes of the present disclosure. It should also be realized by those skilled in the art that such equivalent constructions do not depart from the spirit and scope of the apparatus and method as set forth in the appended claims.

BRIEF DESCRIPTION OF THE DRAWINGS

For a detailed description of the disclosed embodiments of the present disclosure, reference will now be made to the accompanying drawing in which.

DETAILED DESCRIPTION

Figure 1:
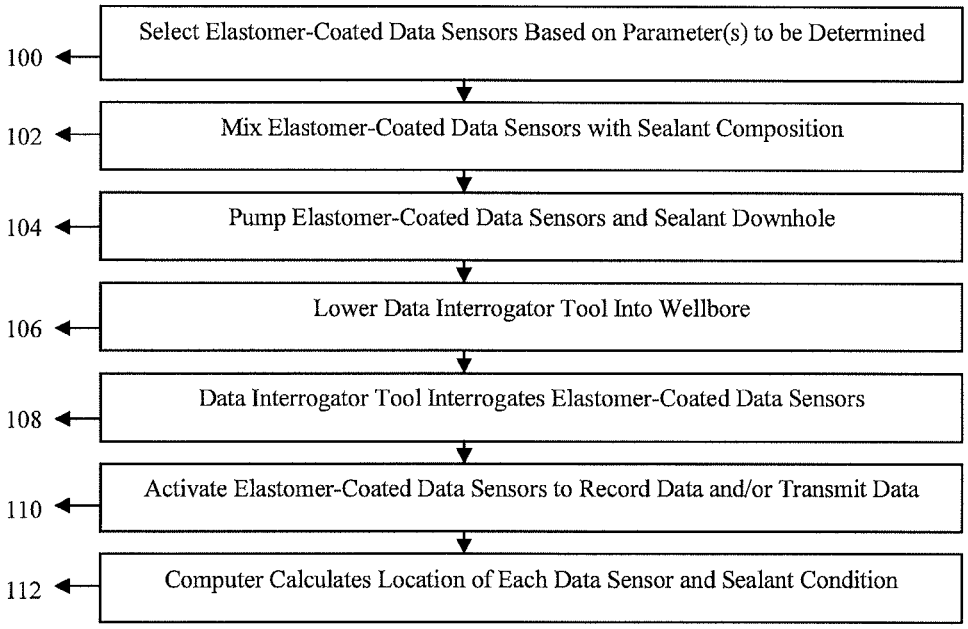
FIG. 1 is a flowchart illustrating an embodiment of a method in accordance with the present disclosure.

Disclosed herein are wellbore servicing compositions (also referred to as wellbore compositions, servicing compositions, wellbore servicing fluids, wellbore fluids, servicing fluids, and the like) comprising one or more sensors optionally coated with an elastomer and methods for utilizing the compositions. As used herein, "elastomer" includes any material or combination of materials which has a tendency to deform and/or compress under an applied force and a further tendency to re-form and/or expand upon removal of the applied force, without substantial adverse effect to the structure of the material. As used herein, "wellbore servicing composition" includes any composition that may be prepared or otherwise provided at the surface and placed down the wellbore, typically by pumping. As used herein, a "sealant" refers to a fluid used to secure components within a wellbore or to plug or seal a void space within the wellbore. Sealants, and in particular cement slurries and non-cementitious compositions, are used as wellbore compositions in several embodiments described herein, and it is to be understood that the methods described herein are applicable for use with other wellbore compositions and/or servicing operation. The wellbore servicing compositions disclosed herein may be used to drill, complete, work over, fracture, repair, treat, or in any way prepare or service a wellbore for the recovery of materials residing in a subterranean formation penetrated by the wellbore. Examples of wellbore servicing compositions include, but are not limited to, cement slurries, non-cementitious sealants, drilling fluids or muds, spacer fluids, fracturing fluids, base fluids of variable-density fluids, or completion fluids. The wellbore servicing compositions are for use in a wellbore that penetrates a subterranean formation, and it will be understood that a wellbore servicing composition that is pumped downhole may be placed in the wellbore, the surrounding subterranean formation, or both as will be apparent in the context of a given servicing operation. It is to be understood that "subterranean formation" encompasses both areas below exposed earth and areas below earth covered by water such as ocean or fresh water. The wellbore may be a substantially vertical wellbore and/or may contain one or more lateral wellbores, for example as produced via directional drilling. As used herein, components are referred to as being "integrated" if they are formed on a common support structure placed in packaging of relatively small size, or otherwise assembled in close proximity to one another.

Embodiments of methods include detecting and/or monitoring the position and/or condition of wellbore servicing compositions and/or the wellbore/surrounding formation using data sensors comprising Micro-Electro-Mechanical System (MEMS) sensors. Embodiments of methods include detecting and/or monitoring the position and/or condition of wellbore servicing compositions and/or the wellbore/surrounding formation using data sensors (e.g., MEMS sensors) which are coated with an elastomer (also referred to herein as "elastomer-coated sensors"). Also disclosed herein are methods of monitoring the integrity and performance of the wellbore servicing compositions, for example during a given wellbore servicing operation and/or over the life of a well, using elastomer-coated sensors (e.g., elastomer-coated MEMS sensors). Also disclosed herein are methods for determining and/or monitoring a condition and/or parameter of a wellbore servicing composition at the surface of a wellsite, for example during mixing or blending of a wellbore servicing composition comprising MEMS sensors. Performance may be indicated by changes, for example, in various parameters, including, but not limited to, expansion or swelling of the elastomer, compression of the elastomer, and moisture content, pressure, density, temperature, pH, and various ion concentrations (e.g., sodium, chloride, and potassium ions) of the composition.

In embodiments, the methods may comprise the use of embeddable data sensors (e.g., MEMS sensors, optionally comprising an elastomer coating, embedded in a wellbore servicing composition) capable of detecting parameters in a wellbore servicing composition, for example a sealant such as cement. In embodiments, the methods provide for evaluation of a sealant during mixing, placement, and/or curing of the sealant within the wellbore. In another embodiment, the method is used for sealant evaluation from placement and curing throughout its useful service life, and where applicable, to a period of deterioration and repair. In embodiments, the methods of this disclosure may be used to prolong the service life of the sealant, lower costs, and enhance creation of improved methods of remediation. Additionally, methods are disclosed for determining the location of sealant within a wellbore, such as for determining the location of a cement slurry during primary cementing of a wellbore as discussed further hereinbelow. Additionally, methods are disclosed for detecting a structural feature such as crack in the composition, e.g., a sealant such as cement, as discussed further hereinbelow.

Figure 5A:
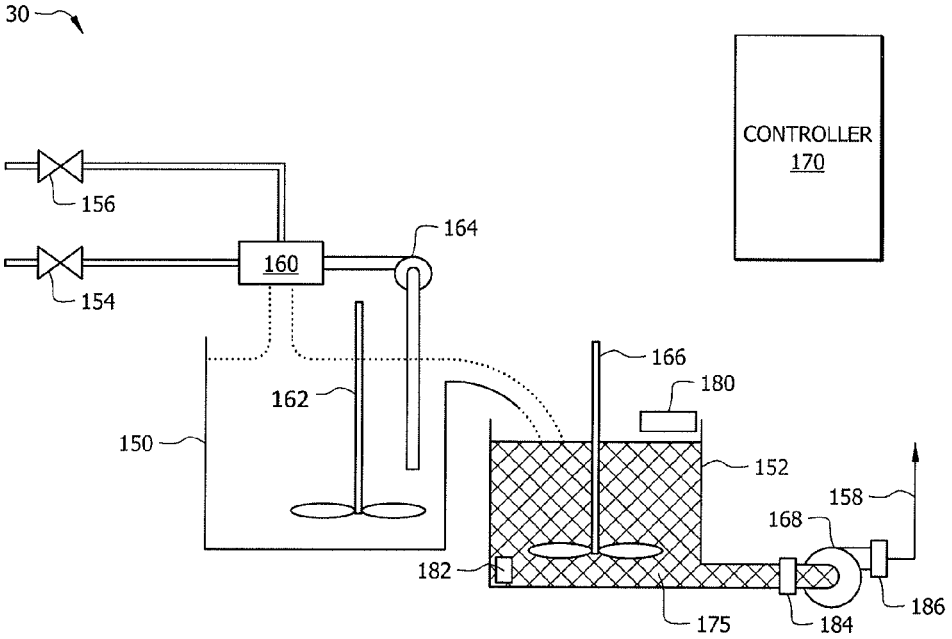
FIG. 5A is a schematic view of an embodiment of a wellbore servicing system according to the disclosure.

Discussion of an embodiment of a method of the present disclosure will now be made with reference to the flowchart of FIG. 1, which includes methods of placing a wellbore servicing composition comprising one or more sensors (e.g., MEMS sensors optionally comprising an elastomer coating) in a subterranean formation. The elastomer-coated sensors may generally be used to gather various types of data or information as described herein. At block 100, elastomer-coated data sensors are selected based on the parameter(s) or other conditions to be determined or sensed within the subterranean formation. At block 102, a quantity of elastomer-coated data sensors is mixed with a wellbore servicing composition, for example, a sealant slurry. In embodiments, data sensors coated with elastomer are added to the wellbore servicing composition (e.g., a sealant) by any methods known to those of skill in the art. For example, for a wellbore servicing composition formulated as a sealant (e.g., a cement slurry), the elastomer-coated sensors may be mixed with a dry material, mixed with one more liquid components (e.g., water or a non-aqueous fluid), or combinations thereof. The mixing may occur onsite, for example sensors may be added into a surface bulk mixer such as a cement slurry mixer, a gel blender (as depicted in FIG. 5A), a sand blender (as depicted in FIG. 5A), a conduit or other component stream, or combinations thereof. The elastomer-coated sensors may be added directly to the mixer, may be added to one or more component streams and subsequently fed to the mixer, may be added downstream of the mixer, or combinations thereof. In embodiments, elastomer-coated data sensors are added after a blending unit and slurry pump, for example, through a lateral by-pass. The elastomer-coated sensors may be metered in and mixed at the wellsite, or may be pre-mixed into the wellbore servicing composition (or one or more components thereof) and subsequently transported to the wellsite. For example, the sensors may be dry mixed with dry cement and transported to the wellsite where a cement slurry is formed comprising the sensors. Alternatively or additionally, the sensors may be pre-mixed with one or more liquid components (e.g., mix water) and transported to the wellsite where a cement slurry is formed comprising the sensors. The properties of the wellbore composition or components thereof may be such that the sensors distributed or dispersed therein do not substantially settle or stratify during transport or placement.

The wellbore servicing composition (e.g., a sealant slurry and elastomer-coated sensors) is then pumped downhole at block 104, whereby the sensors are positioned or placed within the wellbore. For example, the sensors may extend along all or a portion of the length of the wellbore (e.g., in an annular space adjacent casing) and/or into the surrounding formation (e.g., via a fissure or fracture). The composition may be placed downhole as part of a primary cementing, secondary cementing, or other sealant operation as described in more detail herein. At block 106, a data interrogator tool is positioned in an operable location to gather data from the elastomer-coated sensors, for example lowered within the wellbore proximate the sensors. At block 108, the data interrogator tool interrogates the elastomer-coated sensors (e.g., by sending out an RF signal) while the data interrogator tool traverses all or a portion of the wellbore containing the sensors. The elastomer-coated data sensors are activated to record and/or transmit data at block 110 via the signal from the data interrogator tool. At block 112, the data interrogator tool communicates the data to one or more computer components (e.g., memory and/or microprocessor) that may be located within the tool, at the surface, or both. The data may be used locally or remotely from the tool to calculate the location of each elastomer-coated data sensor and correlate the measured parameter(s) to such locations to evaluate performance of the wellbore servicing composition (e.g., sealant).

Data gathering, as shown in blocks 106 to 112 of FIG. 1, may be carried out at the time of initial placement in the well of the servicing composition comprising elastomer-coated sensors, for example during drilling (e.g., a composition comprising drilling fluid and elastomer-coated MEMS sensors) or during cementing (e.g., a composition comprising a cement slurry and elastomer-coated MEMS sensors) as described in more detail below. Additionally or alternatively, data gathering may be carried out at one or more times subsequent to the initial placement in the well of the composition comprising elastomer-coated sensors. For example, data gathering may be carried out at the time of initial placement in the well of the composition comprising elastomer-coated sensors or shortly thereafter to provide a baseline data set. As the well is operated for recovery of natural resources over a period of time, data gathering may be performed additional times, for example at regular maintenance intervals such as every 1 year, 5 years, or 10 years. The data recovered during subsequent monitoring intervals can be compared to the baseline data as well as any other data obtained from previous monitoring intervals, and such comparisons may indicate the overall condition of the wellbore. For example, changes in one or more sensed parameters may indicate one or more problems in the wellbore and/or surrounding formation. Alternatively, consistency or uniformity in sensed parameters may indicate no substantive problems in the wellbore and/or surrounding formation. In an embodiment, data (e.g., sealant parameters) from a plurality of monitoring intervals is plotted over a period of time, and a resultant graph is provided showing an operating or trend line for the sensed parameters. Atypical changes in the graph as indicated for example by a sharp change in slope or a step change on the graph may provide an indication of one or more present problems or the potential for a future problem. Accordingly, remedial and/or preventive treatments or services may be applied to the wellbore to address present or potential problems.

In embodiments, the wellbore servicing composition may be formulated as a sealant (e.g., a cementitious slurry) comprising elastomer-coated sensors. The sealant may comprise any wellbore sealant known in the art. Examples of sealants include cementitious and non-cementitious sealants both of which are well known in the art. In embodiments, non-cementitious sealants comprise resin based systems, latex based systems, or combinations thereof. In embodiments, the sealant comprises a cement slurry with styrene-butadiene latex (e.g., as disclosed in U.S. Pat. No. 5,588,488 incorporated by reference herein in its entirety). Sealants may be utilized in setting expandable casing, which is further described hereinbelow. In other embodiments, the sealant is a cement utilized for primary or secondary wellbore cementing operations, as discussed further hereinbelow.

The sealant may include a sufficient amount of water to form a pumpable slurry. The water may be fresh water or salt water (e.g., an unsaturated aqueous salt solution or a saturated aqueous salt solution such as brine or seawater). In embodiments, the cement slurry may be a lightweight cement slurry containing foam (e.g., foamed cement) and/or hollow beads/microspheres. In an embodiment, elastomer-coated MEMS sensors are incorporated into or attached to all or a portion of the hollow microspheres. Additionally or alternatively, the elastomer-coated sensors may be dispersed within the cement along with the microspheres. Examples of sealants containing microspheres are disclosed in U.S. Pat. Nos. 4,234,344; 6,457,524; and 7,174,962, each of which is incorporated herein by reference in its entirety. In an embodiment, the elastomer-coated sensors are incorporated into a foamed cement such as those described in more detail in U.S. Pat. Nos. 6,063,738; 6,367,550; 6,547,871; and 7,174,962, each of which is incorporated by reference herein in its entirety.

In some embodiments, additives may be included in the sealant for improving or changing the properties thereof. Examples of such additives include but are not limited to accelerators, set retarders, defoamers, fluid loss agents, weighting materials, dispersants, density-reducing agents, formation conditioning agents, lost circulation materials, thixotropic agents, suspension aids, or combinations thereof. Other mechanical property modifying additives, for example, fibers, polymers, resins, latexes, and the like can be added to further modify the mechanical properties. These additives may be included singularly or in combination. Methods for introducing these additives and their effective amounts are known to one of ordinary skill in the art.

In embodiments, the sealant and elastomer-coated sensors may be placed substantially within the annular space between a casing and the wellbore wall. That is, substantially all of the elastomer-coated sensors are located within or in close proximity to the annular space. In an embodiment, the wellbore servicing fluid comprising the elastomer-coated sensors does not substantially penetrate, migrate, or travel into the formation from the wellbore. In an alternative embodiment, substantially all of the elastomer-coated sensors are located within, adjacent to, or in close proximity to the wellbore, for example less than or equal to about 1 foot, 3 feet, 5 feet, or 10 feet from the wellbore. Such adjacent or close proximity positioning of the sensors with respect to the wellbore is in contrast to placing sensors in a fluid that is pumped into the formation in large volumes and substantially penetrates, migrates, or travels into or through the formation, for example as occurs with a fracturing fluid or a flooding fluid. Thus, in embodiments, the elastomer-coated sensors are placed proximate or adjacent to the wellbore (in contrast to the formation at large), and provide information relevant to the wellbore itself and compositions (e.g., sealants) used therein (again in contrast to the formation or a producing zone at large).

In embodiments, the sealant comprising elastomer-coated sensors may be allowed to set (e.g., in the annulus described above, in a subterranean formation, etc.). For example, the sealant may be cementitious and may comprise a hydraulic cement that sets and hardens by reaction with water. Examples of hydraulic cements include but are not limited to Portland cements (e.g., classes A, B, C, G, and H Portland cements), pozzolana cements, gypsum cements, phosphate cements, high alumina content cements, silica cements, high alkalinity cements, shale cements, acid/base cements, magnesia cements, fly ash cement, zeolite cement systems, cement kiln dust cement systems, slag cements, micro-fine cement, metakaolin, and combinations thereof. Examples of sealants are disclosed in U.S. Pat. Nos. 6,457,524; 7,077,203; and 7,174,962, each of which is incorporated herein by reference in its entirety. In an embodiment, the sealant comprises a sorel cement composition, which typically comprises magnesium oxide and a chloride or phosphate salt which together form for example magnesium oxychloride. Examples of magnesium oxychloride sealants are disclosed in U.S. Pat. Nos. 6,664,215 and 7,044,222, each of which is incorporated herein by reference in its entirety.

In additional or alternative embodiments, the wellbore servicing composition may be formulated as a drilling fluid comprising elastomer-coated sensors. Various types of drilling fluids, also known as muds or drill-in fluids have been used in well drilling, such as water-based fluids, oil-based fluids (e.g., mineral oil, hydrocarbons, synthetic oils, esters, etc.), gaseous fluids, or a combination thereof. Drilling fluids typically contain suspended solids. Drilling fluids may form a thin, slick filter cake on the formation face that provides for successful drilling of the wellbore and helps prevent loss of fluid to the subterranean formation. In an embodiment, at least a portion of the elastomer-coated sensors remain associated with the filter cake (e.g., disposed therein) and may provide information as to a condition (e.g., thickness) and/or location of the filter cake. Additionally or in the alternative, at least a portion of the elastomer-coated sensors remain associated with drilling fluid and may provide information as to a condition and/or location of the drilling fluid.

In additional or alternative embodiments, the wellbore servicing composition may be formulated as a fracturing fluid comprising elastomer-coated sensors. Generally, a fracturing fluid comprises a fluid or mixture of fluids that when placed downhole under suitable conditions, induces fractures within the subterranean formation. Hydrocarbon-producing wells often are stimulated by hydraulic fracturing operations, wherein a fracturing fluid may be introduced into a portion of a subterranean formation penetrated by a wellbore at a hydraulic pressure sufficient to create, enhance, and/or extend at least one fracture therein. Stimulating or treating the wellbore in such ways increases hydrocarbon production from the well. In some embodiments, the elastomer-coated sensors may be contained within a wellbore servicing composition that when placed downhole enters and/or resides within one or more fractures within the subterranean formation. In such embodiments, the elastomer-coated sensors provide information as to the location and/or condition of the fluid and/or fracture during and/or after treatment. In an embodiment, at least a portion of the elastomer-coated sensors remain associated with a fracturing fluid and may provide information as to the condition and/or location of the fluid. Fracturing fluids often contain proppants that are deposited within the formation upon placement of the fracturing fluid therein, and in an embodiment a fracturing fluid contains one or more proppants and one or more elastomer-coated sensors. In an embodiment, at least a portion of the elastomer-coated sensors remain associated with the proppants deposited within the formation (e.g., a proppant bed) and may provide information as to the condition (e.g., thickness, density, settling, stratification, integrity, etc.) and/or location of the proppants. Additionally or in the alternative at least a portion of the elastomer-coated sensors remain associated with a fracture (e.g., adhere to and/or retained by a surface of a fracture) and may provide information as to the condition (e.g., length, volume, etc.) and/or location of the fracture. For example, the elastomer-coated sensors may provide information useful for ascertaining the fracture complexity.

In additional or alternative embodiments, the wellbore servicing composition may be formulated as a gravel pack fluid comprising elastomer-coated sensors. Gravel pack fluids may be employed in a gravel packing treatment. The elastomer-coated sensors may provide information as to the condition and/or location of the composition during and/or after the gravel packing treatment. Gravel packing treatments are used, inter alia, to reduce the migration of unconsolidated formation particulates into the wellbore. In gravel packing operations, particulates, referred to as gravel, are carried to a wellbore in a subterranean producing zone by a servicing fluid known as carrier fluid. That is, the particulates are suspended in a carrier fluid, which may be viscosified, and the carrier fluid is pumped into a wellbore in which the gravel pack is to be placed. As the particulates are placed in the zone, the carrier fluid leaks off into the subterranean zone and/or is returned to the surface. The resultant gravel pack acts as a filter to separate formation solids from produced fluids while permitting the produced fluids to flow into and through the wellbore. When installing the gravel pack, the gravel is carried to the formation in the form of a slurry by mixing the gravel with a viscosified carrier fluid. Such gravel packs may be used to stabilize a formation while causing minimal impairment to well productivity. The gravel, inter alia, acts to prevent the particulates from occluding the screen or migrating with the produced fluids, and the screen, inter alia, acts to prevent the gravel from entering the wellbore. In an embodiment, the wellbore servicing composition (e.g., gravel pack fluid) comprises a carrier fluid, gravel and one or more elastomer coated MEMS sensors. In an embodiment, at least a portion of the elastomer-coated sensors remains associated with the gravel deposited within the wellbore and/or subterranean formation (e.g., a gravel pack/bed) after removal of the carrier fluid and may provide information as to the condition (e.g., thickness, density, settling, stratification, integrity, etc.) and/or location of the gravel pack/bed.

In additional or alternative embodiments, the wellbore servicing composition may be formulated as a spacer fluid comprising elastomer-coated sensors. Spacer fluids may be used to separate two other fluids (e.g., two other wellbore servicing fluids) from one another, due to a specialized purpose for the separated fluids, a possibility of contamination, incompatibility (e.g., chemically), or combinations thereof. For example, a spacer fluid (e.g., an aqueous fluid such as water) may be used to separate a sealant and a drilling fluid in the wellbore during cementing operations. In embodiments, the elastomer-coated sensors may provide information regarding the location, position, integrity, flow, etc. of the spacer fluid.

In additional or alternative embodiments, the wellbore servicing composition may be formulated as a completion fluid comprising elastomer-coated sensors. Completion fluids may be used to prevent damage to a well upon completion, and for example may comprise brines such as formates, chlorides, or bromides. In embodiments, the elastomer-coated sensors may provide information regarding the location, position, of the completion fluid, and additionally or alternatively, the integrity of the completed well over the life of the well.

In additional or alternative embodiments, the wellbore servicing composition may comprise a base fluid (e.g., an aqueous fluid, oleaginous fluid, or both) and one or more elastomer-coated sensors. In such embodiments, the wellbore servicing composition may be referred to as a variable-density fluid. The density of the variable-density fluid may vary as a function of pressure. For example, the variable-density fluid may encounter higher pressures (e.g., as the wellbore servicing composition is placed downhole) than at a previous pressure (e.g., the pressure at sea level), and the elastomer coatings compress against the sensors and decrease the volume of the elastomer coating of the sensors, and thus, of the elastomer-coated sensors. The decrease in volume of the elastomer-coated sensors increases the density of the variable-density fluid. In embodiments, the density of the variable-density fluid may increase from 0.1% to 300% of the density of the variable-density fluid at earth or sea level. Likewise, the variable-density fluid may encounter lower pressures (e.g., as the wellbore servicing composition is moved upward through the wellbore, into a low pressure environment in the subterranean formation, or combinations thereof) than at a previous pressure (e.g., a downhole pressure, a pressure of a subterranean formation, or combinations thereof), and the elastomer coatings expand and increase the volume of the elastomer-coated sensors. The increase in volume of the elastomer-coated sensors decreases the density of the variable-density fluid.

In embodiments, the variable density fluid may vary in density at particular phases of a subterranean operation (e.g., drilling, fracturing, or the like) as may be necessary to adapt to the subterranean conditions to which the fluid is subjected. For example, where the variable density fluid is utilized in offshore drilling applications, the variable density fluid may have a lower density when located above the ocean floor, and subsequently have a higher density when located within the well bore beneath the ocean floor. Generally, the variable density fluid may have a density in the range of about 4 lb/gallon to about 18 lb/gallon when measured at sea level. When utilized in offshore applications, the variable density fluids may have a density in the range of about 6 lb/gallon to about 20 lb/gallon, measured when at a point of maximum compression.

In embodiments, the base fluid of the variable density fluid may comprise an aqueous-based fluid, a non-aqueous-based fluid, or mixtures thereof. When aqueous-based, the water utilized can be fresh water, salt water (e.g., water containing one or more salts dissolved therein), brine (e.g., saturated salt water), seawater, or combinations thereof. Generally, the water can be from any source provided that it does not contain an excess of compounds that may adversely affect other components in the variable density fluid. When non-aqueous-based, the base fluid may comprise any number of organic fluids. Examples of suitable organic fluids may include mineral oils; synthetic oils; esters; hydrocarbons; oil; diesel; naturally occurring oils such as vegetable, plant, seed, or nut oils; the like; or combinations thereof. Generally, any oil in which a water solution of salts can be emulsified (or vice-versa) may be suitable for use in a variable-density fluid. Generally, the base fluid may be present in an amount sufficient to form a pumpable wellbore composition (e.g., a variable density fluid). For example, the base fluid is typically present in the disclosed composition in an amount in the range of about 20% to about 99.99% by volume of the composition.

In one or more embodiments, the elastomer (i.e., the elastomer which coats the sensors) may comprise any material or combination of materials which has a tendency to deform and/or compress under an applied force and a further tendency to re-form and/or expand upon removal of the applied force, without substantial adverse effect to the structure of the material. In additional or alternative embodiments, the elastomer may comprise any material or combination of materials which may swell when in contact with a certain fluid (e.g., a hydrocarbon or water), when subject to a temperature which causes swelling, when subject to a pressure which causes swelling, when subject to a particular pH, or combinations thereof. Suitable elastomers may comprise a specific gravity in the range of about 0.05 to about 2.00; alternatively, in the range of about 0.05 to about 0.99; alternatively, in the range of about 1.00 to about 2.00. In embodiments, the elastomer may be shear resistant, fatigue resistant, substantially impermeable to fluids typically encountered in subterranean formations, or combinations thereof. In embodiments, the elastomer may comprise an isothermal compressibility factor in the range of about $1.5\times10^{-3}$ (l/psi) to about $1.5\times10^{-9}$ (l/psi), where "isothermal compressibility factor" is defined as a change in volume with pressure, per unit volume of the elastomer, at a constant temperature. In embodiments, the elastomer may be suitable for use in temperatures up to about 500° F. without degrading. In additional or alternative embodiments, the elastomer coating may be suitable for use in pressures up to about 21,000 psi without crushing the sensors (e.g., MEMS sensors).

Suitable elastomers (e.g., for MEMS sensors comprising an elastomer coating) may comprise a polymer and/or copolymer that, at a given temperature and pressure, changes volume by expansion and compression, and consequently, may change the density of the wellbore composition (e.g., variable density fluid). In embodiments, the elastomer may comprise a copolymer of styrene and divinylbenzene; a copolymer of methylmethacrylate and acrylonitrile; a copolymer of styrene and acrylonitrile; a terpolymer of methylmethacrylate, acrylonitrile, and vinylidene dichloride; a terpolymer of styrene, vinylidene chloride, and acrylonitrile; a phenolic resin; polystyrene; or combinations thereof. Examples of suitable elastomers are disclosed in U.S. Pat. No. 7,749,942, which is incorporated herein in its entirety. In additional or alternative embodiments, the elastomer may comprise a WellLife® material, which is an elastomeric material commercially available from Halliburton.

Suitable elastomers, such as those described above, can be chosen according to the ability to withstand the temperatures and pressures associated with pumping and/or circulating through an annulus of a wellbore around a casing, into a subterranean formation, through a drill bit, or combinations thereof. Additionally or alternatively, suitable elastomers can be chosen according to the ability to withstand the temperatures and pressures associated with curing and setting of cements in a wellbore and/or subterranean formation. In embodiments where the composition is moved through wellbore equipment or a subterranean formation, the elastomer may resist adhering to the wellbore equipment (e.g., drill pipe, the drill bit) or the subterranean formation.

In embodiments, the sensors are coated with an elastomer by methods recognized by those skilled in the art with the aid of this disclosure. For example, the sensors may be dipped in a liquid comprising the elastomer which then forms an elastomer coating upon drying. Alternatively, the elastomer may be melted and the sensors mixed and distributed into a molten elastomer (e.g., via compounding and/or extruding) and subsequently pelletized. Alternatively, the elastomer may be spray coated upon the sensors. Alternatively, the elastomer may be formed (e.g., polymerized) in the presence of the sensors. For example, the sensors (e.g., MEMS sensors) may be fluidized in a gas phase polymerization process wherein the sensors are coated as reactants polymerize to form the elastomer coating. In an embodiment, the sensors are coated in combination with one or more additional particulate materials to be employed in a given wellbore servicing composition. For example, particulate material (e.g., sand, gravel, etc.) and sensors (e.g., MEMS sensors) could be mixed and then subjected to a coating process of the type described herein to yield an elastomer coated particulate mixture comprising elastomer-coated sensors (e.g., a elastomer-coated proppant material comprising sensors, and elastomer-coated gravel pack material comprising sensors, etc.). In embodiments, the thickness of the elastomer coating on the sensors may range from about 0.0001 mm to 10 mm; 0.0001 to 1 mm; 0.0001 to 0.1 mm; 0.001 to 10 mm; 0.001 to 1 mm; 0.001 to 0.1 mm; or any suitable range within these endpoints.

In embodiments, the sensors contained within the elastomer coatings may be silicon-based and/or non-silicon based. Silicon-based sensors utilize silicon, for example, as a substrate for the sensor. Non-silicon based sensors may include LCD sensors, conductive polymer sensors, biopolymer sensors, or combinations thereof. In embodiments, the sensors may comprise a polymer diode which provides data at low frequencies, which enables the sensors to provide information through thicker mediums (e.g., the compositions disclosed herein, a subterranean formation, casing, a drill string, or combinations thereof) than would otherwise be possible at frequencies above the low frequencies of the polymer diode. Suitable sensors are disclosed in U.S. Pat. No. 7,832,263, which is incorporated herein by reference in its entirety.

In additional or alternative embodiments, the sensors contained within the elastomer coatings may comprise micro-electromechanical systems (MEMS) comprising one or more (and typically a plurality of) MEMS devices, referred to herein as MEMS sensors. Suitable MEMS devices may be selected with the aid of this disclosure, e.g., a semiconductor device with mechanical features on the micrometer scale. The MEMS devices disclosed herein may be on the nanometer to micrometer scale. MEMS sensors embody the integration of mechanical elements, sensors, actuators, and electronics on a common substrate such as silicon or non-silicon based substrates. MEMS elements may include mechanical elements which are movable by an input energy (electrical energy or other type of energy).

Using MEMS, a sensor may be designed to emit a detectable signal based on a number of physical phenomena, including thermal, biological, optical, chemical, and magnetic effects or stimulation. MEMS devices are minute in size, have low power requirements, are relatively inexpensive and are rugged, and thus are well suited for use in wellbore servicing compositions and related operations.

In embodiments, the elastomer-coated sensors may sense one or more parameters within the wellbore, within a wellbore servicing fluid, within a subterranean formation, or combinations thereof. In embodiments, the one or more parameters may comprise temperature, pH, moisture content, ion concentration (e.g., chloride, sodium, and/or potassium ions), well cement characteristic data (e.g., stress, strain, cracks, voids, gaps, or combinations thereof), expansion of the elastomer, compression of the elastomer, swelling of the elastomer, other parameters disclosed herein, or combinations thereof. In embodiments, the elastomer-coated sensors may sense a change in configuration of the elastomer-coated sensor, for example a change in the deflection, stress, strain, and/or thickness of the elastomer coating (e.g., due to a change in pressure and/or temperature), an activation or deactivation of the sensor (e.g., due to a change in one or more of the parameters described herein), a change in transmission frequency, a change in time between transmissions, or combinations thereof.

In embodiments, the sensors coated with an elastomer (e.g., MEMS sensors, LCD sensors, conductive polymer sensors, bio-polymer sensors, or combinations thereof) may provide information as to a location, flow path/profile, volume, density, temperature, pressure, the presence or absence of a particular fluid (e.g., water, a hydrocarbon), or a combination thereof, for a drilling fluid, a fracturing fluid, a gravel pack fluid, or other wellbore servicing fluid in real time such that the effectiveness of such service may be monitored and/or adjusted during performance of the service to improve the result of same. Accordingly, the elastomer-coated sensors may aid in the initial performance of the wellbore service additionally or alternatively to providing a means for monitoring a wellbore condition or performance of the service over a period of time (e.g., over a servicing interval and/or over the life of the well). For example, the one or more elastomer-coated sensors may be used in monitoring a gas or a liquid produced from the subterranean formation. Elastomer-coated sensors present in the wellbore and/or formation may be used to provide information as to the condition (e.g., temperature, pressure, flow rate, composition, etc.) and/or location of a gas or liquid produced from the subterranean formation. In an embodiment, the elastomer-coated sensors provide information regarding the composition of a produced gas or liquid. For example, the elastomer-coated sensors may be used to monitor an amount of water produced in a hydrocarbon producing well (e.g., amount of water present in hydrocarbon gas or liquid), an amount of undesirable components or contaminants in a produced gas or liquid (e.g., sulfur, carbon dioxide, hydrogen sulfide, etc. present in hydrocarbon gas or liquid), or a combination thereof.

In additional or alternative embodiments, the elastomer-coated sensors may provide information regarding the structural integrity of a wellbore servicing composition (e.g., a composition disclosed herein, such as a sealant comprising a cement) which has set. For example, the elastomer-coated sensors may be used to detect the presence or absence of a fluid (e.g., a hydrocarbon or water) present in compromised areas (e.g., cracks, voids, gaps, chips) of the cement. The elastomer-coated sensors may be used to detect the presence or absence of a gas or liquid. The elastomer coating of a sensor embedded within the composition (e.g., set cement) may expand and/or swell in the presence of the fluid (e.g., hydrocarbon), creating a greater pressure on the sensor which is detected by the sensor. The elastomer coating of a sensor may also retract and release the pressure of swelling or expansion upon removal of the fluid from presence at the elastomer coating of the sensors.

In addition or in the alternative, an elastomer-coated sensor incorporated within one or more of the wellbore servicing compositions disclosed herein may provide information that allows a condition (e.g., thickness, density, volume, settling, stratification, etc.) and/or location of the wellbore servicing composition within the subterranean formation to be detected.

In embodiments, the sensors contained within the elastomer coating are ultra-small, e.g., 3 $mm^2$, such that the elastomer-coated sensors are pumpable in the disclosed wellbore servicing compositions (e.g., a sealant slurry, a variable density fluid, a fracturing mixture, etc.). In embodiments, the MEMS device of the elastomer-coated sensor may be approximately 0.01 $mm^2$ to 1 $mm^2$, alternatively 1 $mm^2$ to 3 $mm^2$, alternatively 3 $mm^2$ to 5 $mm^2$, or alternatively 5 $mm^2$ to 10 $mm^2$. In embodiments, the elastomer-coated sensors may be approximately 0.01 $mm^2$ to 10 $mm^2$. In embodiments, the elastomer-coated data sensors are capable of providing data throughout the service life of the wellbore servicing composition (e.g., a set cement). In embodiments, the elastomer-coated data sensors are capable of providing data for up to 100 years. In an embodiment, the composition comprises an amount of elastomer-coated sensors effective to measure one or more desired parameters. In various embodiments, the wellbore servicing composition comprises an effective amount of elastomer-coated sensors such that sensed readings may be obtained at intervals of about 1 foot, alternatively about 6 inches, or alternatively about 1 inch, along the portion of the wellbore containing the elastomer-coated sensors. In an embodiment, the elastomer-coated sensors may be present in the disclosed wellbore servicing compositions in an amount of from about 0.001 to about 10 weight percent. Alternatively, the elastomer-coated sensors may be present in the disclosed wellbore servicing compositions in an amount of from about 0.01 to about 5 weight percent.

In embodiments, the elastomer-coated sensors added to (e.g., mixed with) the wellbore servicing composition may comprise passive sensors that do not require continuous power from a battery or an external source in order to transmit real-time data. Additionally or alternatively, the elastomer-coated sensors may comprise an active material connected to (e.g., mounted within or mounted on the surface of) an enclosure, the active material being liable to respond to a wellbore parameter, and the active material being operably connected to (e.g., in physical contact with, surrounding, or coating) a capacitive MEMS element. In embodiments, the elastomer-coated sensors of the present disclosure may comprise one or more active materials that respond to two or more the parameters described herein. In such a way, two or more parameters may be monitored.

Suitable active materials, such as dielectric materials, that respond in a predictable and stable manner to changes in parameters over a long period may be identified according to methods well known in the art, for example see, e.g., Ong, Zeng and Grimes. "A Wireless, Passive Carbon Nanotube-based Gas Sensor," IEEE Sensors Journal, 2, 2, (2002) 82-88; Ong, Grimes, Robbins and Singl, "Design and application of a wireless, passive, resonant-circuit environmental monitoring sensor," Sensors and Actuators A, 93 (2001) 33-43, each of which is incorporated by reference herein in its entirety. MEMS sensors suitable for the methods of the present disclosure that respond to various wellbore parameters are disclosed in U.S. Pat. No. 7,038,470 B 1 that is incorporated herein by reference in its entirety.

In embodiments, the sensors encased in the elastomer coatings are coupled with radio frequency identification devices (RFIDs) and can thus detect and transmit parameters and/or well cement characteristic data for monitoring the cement during its service life. RFIDs combine a microchip with an antenna (the RFID chip and the antenna are collectively referred to as the "transponder" or the "tag"). The antenna provides the RFID chip with power when exposed to a narrow band, high frequency electromagnetic field from a transceiver. A dipole antenna or a coil, depending on the operating frequency, connected to the RFID chip, powers the transponder when current is induced in the antenna by an RF signal from the transceiver's antenna. Such a device can return a unique identification "ID" number by modulating and re-radiating the radio frequency (RF) wave. Passive RF tags are gaining widespread use due to their low cost, indefinite life, simplicity, efficiency, ability to identify parts at a distance without contact (tether-free information transmission ability). These robust and tiny tags are attractive from an environmental standpoint as they require no battery. The sensor and RFID tag are preferably integrated into a single component (e.g., chip or substrate), or may alternatively be separate components operably coupled to each other. In an embodiment, an integrated, passive MEMS/RFID elastomer-coated sensor contains a data sensing component, an optional memory, and an RFID antenna, whereby excitation energy is received and powers up the sensor, thereby sensing a present condition and/or accessing one or more stored sensed conditions from memory and transmitting same via the RFID antenna.

Within the United States, commonly used operating bands for RFID systems center on one of the three government assigned frequencies: 125 kHz, 13.56 MHz or 2.45 GHz. A fourth frequency, 27.125 MHz, has also been assigned. When the 2.45 GHz carrier frequency is used, the range of an RFID chip can be many meters. While this is useful for remote sensing, there may be multiple transponders within the RF field. In order to prevent these devices from interacting and garbling the data, anti-collision schemes are used, as are known in the art. In embodiments, the data sensors are integrated with local tracking hardware to transmit their position as they flow within a sealant slurry. The data sensors may form a network using wireless links to neighboring data sensors and have location and positioning capability through, for example, local positioning algorithms as are known in the art. The sensors may organize themselves into a network by listening to one another, therefore allowing communication of signals from the farthest sensors towards the sensors closest to the interrogator to allow uninterrupted transmission and capture of data. In such embodiments, the interrogator tool may not need to traverse the entire section of the wellbore containing elastomer-coated sensors in order to read data gathered by such sensors. For example, the interrogator tool may only need to be lowered about halfway along the vertical length of the wellbore containing elastomer-coated sensors. Alternatively, the interrogator tool may be lowered vertically within the wellbore to a location adjacent to a horizontal arm of a well, whereby elastomer-coated sensors located in the horizontal arm may be read without the need for the interrogator tool to traverse the horizontal arm. Alternatively, the interrogator tool may be used at or near the surface and read the data gathered by the sensors distributed along all or a portion of the wellbore. For example, sensors located distal to the interrogator may communicate via a network formed by the sensors as described previously.

In embodiments, the elastomer-coated sensors comprise passive (remain unpowered when not being interrogated) sensors energized by energy radiated from a data interrogator tool. The data interrogator tool may comprise an energy transceiver sending energy (e.g., radio waves) to and receiving signals from the elastomer-coated sensors and a processor processing the received signals. The data interrogator tool may further comprise a memory component, a communications component, or both. The memory component may store raw and/or processed data received from the elastomer-coated sensors, and the communications component may transmit raw data to the processor and/or transmit processed data to another receiver, for example located at the surface. The tool components (e.g., transceiver, processor, memory component, and communications component) are coupled together and in signal communication with each other.

In an embodiment, one or more of the data interrogator components may be integrated into a tool or unit that is temporarily or permanently placed downhole (e.g., a downhole module). In an embodiment, a removable downhole module comprises a transceiver and a memory component, and the downhole module is placed into the wellbore, reads data from the elastomer-coated sensors, stores the data in the memory component, is removed from the wellbore, and the raw data is accessed. Alternatively, the removable downhole module may have a processor to process and store data in the memory component, which is subsequently accessed at the surface when the tool is removed from the wellbore. Alternatively, the removable downhole module may have a communications component to transmit raw data to a processor and/or transmit processed data to another receiver, for example located at the surface. The communications component may communicate via wired or wireless communications. For example, the downhole component may communicate with a component or other node on the surface via a cable or other communications/telemetry device such as a radio frequency, electromagnetic telemetry device or an acoustic telemetry device. The removable downhole component may be intermittently positioned downhole via any suitable conveyance, for example wire-line, coiled tubing, straight tubing, gravity, pumping, etc., to monitor conditions at various times during the life of the well.

In embodiments, the data interrogator tool comprises a permanent or semi-permanent downhole component that remains downhole for extended periods of time. For example, a semi-permanent downhole module may be retrieved and data downloaded once every few years. Alternatively, a permanent downhole module may remain in the well throughout the service life of well. In an embodiment, a permanent or semi-permanent downhole module comprises a transceiver and a memory component, and the downhole module is placed into the wellbore, reads data from the elastomer-coated sensors, optionally stores the data in the memory component, and transmits the read and optionally stored data to the surface. Alternatively, the permanent or semi-permanent downhole module may have a processor to process and sensed data into processed data, which may be stored in memory and/or transmit to the surface. The permanent or semi-permanent downhole module may have a communications component to transmit raw data to a processor and/or transmit processed data to another receiver, for example located at the surface. The communications component may communicate via wired or wireless communications. For example, the downhole component may communicate with a component or other node on the surface via a cable or other communications/telemetry device such as a radio frequency, electromagnetic telemetry device or an acoustic telemetry device.

In embodiments, the data interrogator tool comprises an RF energy source incorporated into its internal circuitry and the data sensors are passively energized using an RF antenna, which picks up energy from the RF energy source. In an embodiment, the data interrogator tool is integrated with an RF transceiver. In embodiments, the elastomer-coated sensors (e.g., MEMS/RFID sensors) are empowered and interrogated by the RF transceiver from a distance, for example a distance of greater than 10 m, or alternatively from the surface or from an adjacent offset well. In an embodiment, the data interrogator tool traverses within a casing in the well and reads elastomer-coated sensors located in a sealant (e.g., cement) sheath surrounding the casing and located in the annular space between the casing and the wellbore wall. In embodiments, the interrogator senses the elastomer-coated sensors when in close proximity with the sensors, typically via traversing a removable downhole component along a length of the wellbore comprising the elastomer-coated sensors. In an embodiment, close proximity comprises a radial distance from a point within the casing to a planar point within an annular space between the casing and the wellbore. In embodiments, close proximity comprises a distance of 0.1 m to 1 m. Alternatively, close proximity comprises a distance of 1 m to Sm. Alternatively, close proximity comprises a distance of from S m to 10 m. In embodiments, the transceiver interrogates the sensor with RF energy at 125 kHz and close proximity comprises 0.1 m to 0.25 m. Alternatively, the transceiver interrogates the sensor with RF energy at 13.5 MHz and close proximity comprises 0.25 m to 0.5 m. Alternatively, the transceiver interrogates the sensor with RF energy at 915 MHz and close proximity comprises 0.5 m to 1 m. Alternatively, the transceiver interrogates the sensor with RF energy at 2.4 GHz and close proximity comprises 1 m to 2 m.

In embodiments, the elastomer-coated sensors are incorporated into wellbore cement and used to collect data during and/or after cementing the wellbore. The data interrogator tool may be positioned downhole during cementing, for example integrated into a component such as casing, casing attachment, plug, cement shoe, or expanding device. Alternatively, the data interrogator tool is positioned downhole upon completion of cementing, for example conveyed downhole via wireline. The cementing methods disclosed herein may optionally comprise the step of foaming the cement composition using a gas such as nitrogen or air. The foamed cement compositions may comprise a foaming surfactant and optionally a foaming stabilizer. The elastomer-coated sensors may be incorporated into a sealant composition and placed downhole, for example during primary cementing (e.g., conventional or reverse circulation cementing), secondary cementing (e.g., squeeze cementing), or other sealing operation (e.g., behind an expandable casing).

In primary cementing, cement is positioned in a wellbore to isolate an adjacent portion of the subterranean formation and provide support to an adjacent conduit (e.g., casing). The cement forms a barrier that prevents fluids (e.g., water or hydrocarbons) in the subterranean formation from migrating into adjacent zones or other subterranean formations. In embodiments, the wellbore in which the cement is positioned belongs to a horizontal or multilateral wellbore configuration. It is to be understood that a multilateral wellbore configuration includes at least two principal wellbores connected by one or more ancillary wellbores.

Figure 2:
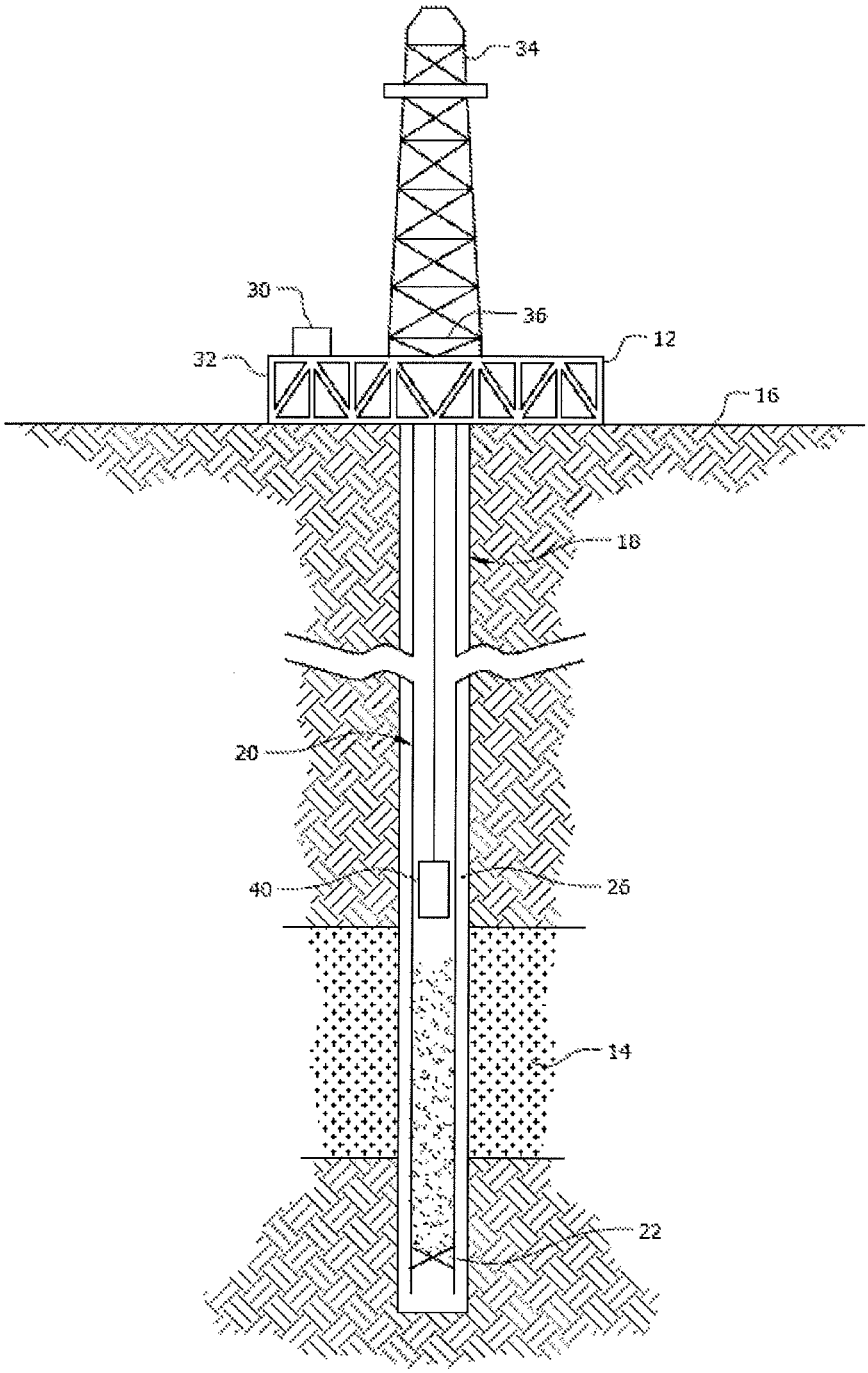
FIG. 2 is a schematic of a typical onshore oil or gas drilling rig and wellbore.
Figure 5B:
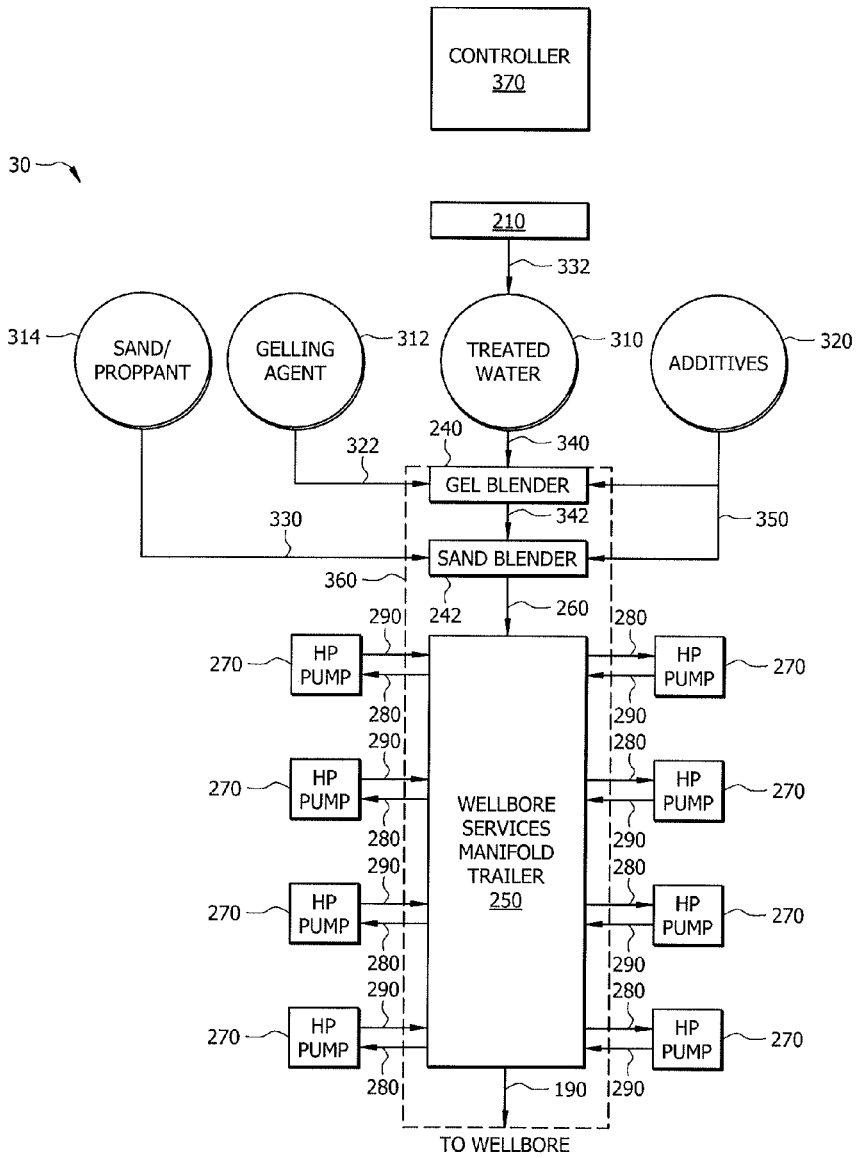
FIG. 5B is a schematic view of another embodiment of a wellbore servicing system according to the disclosure.
Figure 6:
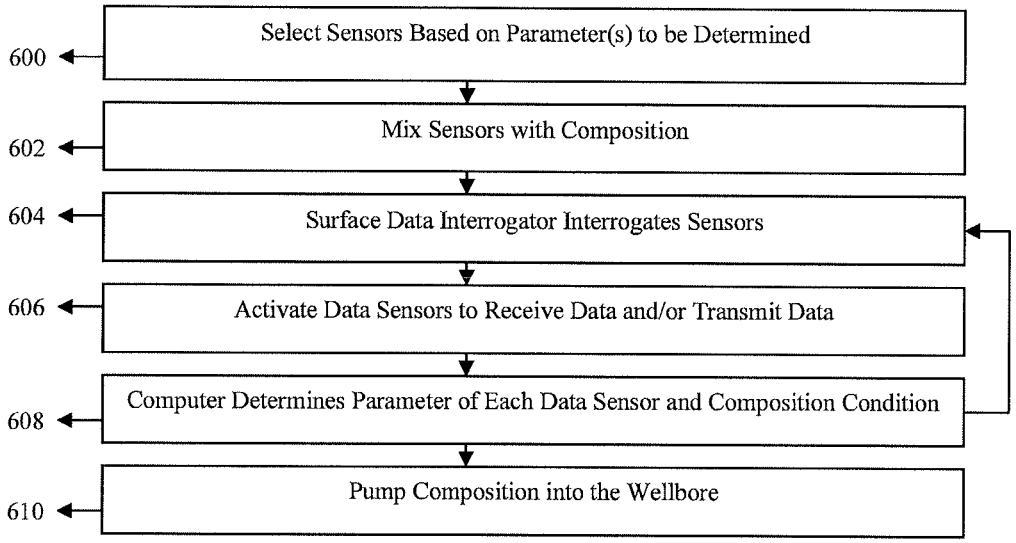
FIG. 6 is a flowchart illustrating an embodiment of a method according to the disclosure.

FIG. 2, which shows a typical onshore oil or gas drilling rig and wellbore, will be used to clarify the methods of the present disclosure, with the understanding that the present disclosure is likewise applicable to offshore rigs and wellbores. Rig 12 is centered over a subterranean formation 14 located below the earth's surface 16. Rig 12 includes a work deck 32 that supports a derrick 34. Derrick 34 supports a hoisting apparatus 36 for raising and lowering pipe strings such as casing 20. Wellbore servicing system 30 is capable of pumping a variety of wellbore compositions (e.g., drilling fluid or cement) into the well and includes a pressure measurement device that provides a pressure reading at the pump discharge. The wellbore servicing system 30 may fluidly connect to the wellbore 18, for example via a conduit (e.g., conduit 190 as shown in FIGS. 5 and 6 and described hereinbelow). Wellbore 18 has been drilled through the various earth strata, including formation 14. Upon completion of wellbore drilling, casing 20 is often placed in the wellbore 18 to facilitate the production of oil and gas from the formation 14. Casing 20 is a string of pipes that extends down wellbore 18, through which oil and gas will eventually be extracted. A cement or casing shoe 22 is typically attached to the end of the casing string when the casing string is run into the wellbore 18. Casing shoe 22 guides casing 20 toward the center of the hole and minimizes problems associated with hitting rock ledges or washouts in wellbore 18 as the casing string 20 is lowered into the well. Casing shoe, 22, may be a guide shoe or a float shoe, and typically comprises a tapered, often bullet-nosed piece of equipment found on the bottom of casing string 20. Casing shoe, 22, may be a float shoe fitted with an open bottom and a valve that serves to prevent reverse flow, or U-tubing, of cement slurry from annulus 26 into casing 20 as casing 20 is run into wellbore 18. The region between casing 20 and the wall of wellbore 18 is known as the casing annulus 26. To fill up casing annulus 26 and secure casing 20 in place, casing 20 is usually "cemented" in wellbore 18, which is referred to as "primary cementing." A data interrogator tool 40 is shown in the wellbore 18.

In an embodiment, the method of this disclosure is used for monitoring primary cement during and/or subsequent to a conventional primary cementing operation. In this conventional primary cementing embodiment, sensors coated with an elastomer are mixed into a cement slurry, block 102 of FIG. 1, and the cement slurry is then pumped down the inside of casing 20, block 104 of FIG. 1. As the slurry reaches the bottom of casing 20, it flows out of casing 20 and into casing annulus 26 between casing 20 and the wall of wellbore 18. As cement slurry flows up annulus 26, it displaces any fluid in the wellbore 18. To ensure no cement remains inside casing 20, devices called "wipers" may be pumped by a wellbore servicing fluid (e.g., drilling mud) through casing 20 behind the cement. The wiper contacts the inside surface of casing 20 and pushes any remaining cement out of casing 20. When cement slurry reaches the earth's surface 16, and annulus 26 is filled with slurry, pumping is terminated and the cement is allowed to set. The elastomer-coated sensors of the present disclosure may also be used to determine one or more parameters during placement and/or curing of the cement slurry. Also, the elastomer-coated sensors of the present disclosure may also be used to determine completion of the primary cementing operation, as further discussed herein below.

During cementing, or subsequent the setting of cement, a data interrogator tool 40 may be positioned in wellbore 18, as described at block 106 of FIG. 1. In embodiments such as that shown in FIG. 2, the interrogator tool 40 may be run downhole via a wireline or other conveyance. In alternative embodiments, the wiper may be equipped with a data interrogator tool 40 and may read data from the elastomer-coated sensors while being pumped downhole and transmit same to the surface. In alternative embodiments, an interrogator tool 40 may be run into the wellbore 18 following completion of cementing a segment of casing, for example as part of the drill string during resumed drilling operations. The data interrogator tool 40 may then be signaled to interrogate the elastomer-coated sensors (as described at block 108 of FIG. 1) whereby the elastomer-coated sensors are activated to record and/or transmit data (as described in block 110 of FIG. 1). The data interrogator tool 40 communicates the data to computer (e.g., a processor) whereby data sensor (and likewise cement slurry) position and cement integrity may be determined (e.g., calculated as described at block 112 of FIG. 1) via analyzing sensed parameters for changes, trends, expected values, etc. For example, such data may reveal conditions that may be adverse to cement curing. The elastomer-coated sensors may provide a temperature profile over the length of the cement sheath, with a uniform temperature profile likewise indicating a uniform cure (e.g., produced via heat of hydration of the cement during curing) or a cooler zone might indicate the presence of water that may degrade the cement during the transition from slurry to set cement. Alternatively, such data may indicate a zone of reduced, minimal, or missing sensors, which would indicate a loss of cement corresponding to the area (e.g., a loss/void zone or water influx/washout). Alternatively, such data may indicate swelling or expansion of the elastomer in the cement due to, for example, the presence of a hydrocarbon in a crack, void, gap, etc. of the cement. Such methods may be available with various cement techniques described herein such as conventional or reverse primary cementing.

Due to the high pressure at which the cement is pumped during conventional primary cementing (pump down the casing and up the annulus), fluid from the cement slurry may leak off into existing low pressure zones traversed by the wellbore 18. This may adversely affect the cement, and incur undesirable expense for remedial cementing operations (e.g., squeeze cementing as discussed hereinbelow) to position the cement in the annulus. Such leak off may be detected via the present disclosure as described previously. For example, the elastomer may expand or compress indicating a change in density of the cement after the fluid leaks off. Additionally, conventional circulating cementing may be time-consuming, and therefore relatively expensive, because cement is pumped all the way down casing 20 and back up annulus 26.

One method of avoiding problems associated with conventional primary cementing is to employ reverse circulation primary cementing. Reverse circulation cementing is a term of art used to describe a method where a cement slurry is pumped down casing annulus 26 instead of into casing 20. The cement slurry displaces any fluid as it is pumped down annulus 26. Fluid in the annulus is forced down annulus 26, into casing 20 (along with any fluid in the casing), and then back up to earth's surface 16. When reverse circulation cementing, casing shoe 22 comprises a valve that is adjusted to allow flow into casing 20 and then sealed after the cementing operation is complete. Once slurry is pumped to the bottom of casing 20 and fills annulus 26, pumping is terminated and the cement is allowed to set in annulus 26. Examples of reverse cementing applications are disclosed in U.S. Pat. Nos. 6,920,929 and 6,244,342, each of which is incorporated herein by reference in its entirety.

In embodiments of the present disclosure, a sealant comprising elastomer-coated data sensors (e.g., a sealant slurry) is pumped down the annulus 26 in reverse circulation applications, a data interrogator 40 is located within the wellbore 18 (e.g., by wireline as shown in FIG. 2 or integrated into the casing shoe) and sealant performance is monitored as described with respect to the conventional primary sealing method disclosed hereinabove. Additionally, the elastomer-coated data sensors of the present disclosure may also be used to determine completion of a reverse circulation operation, as further discussed hereinbelow.

Secondary cementing within a wellbore (e.g., wellbore 18) may be carried out subsequent to primary cementing operations. A common example of secondary cementing is squeeze cementing wherein a sealant such as a cement composition is forced under pressure into one or more permeable zones within the wellbore to seal such zones. Examples of such permeable zones include fissures, cracks, fractures, streaks, flow channels, voids, high permeability streaks, annular voids, or combinations thereof. The permeable zones may be present in the cement column residing in the annulus, a wall of the conduit in the wellbore, a microannulus between the cement column and the subterranean formation, and/or a microannulus between the cement column and the conduit. The sealant (e.g., secondary cement composition) sets within the permeable zones, thereby forming a hard mass to plug those zones and prevent fluid from passing therethrough (i.e., prevents communication of fluids between the wellbore and the formation via the permeable zone). Various procedures that may be followed to use a sealant composition in a wellbore are described in U.S. Pat. No. 5,346,012, which is incorporated by reference herein in its entirety. In various embodiments, a sealant composition comprising elastomer-coated sensors is used to repair holes, channels, voids, and microannuli in casing, cement sheath, gravel packs, and the like as described in U.S. Pat. Nos. 5,121,795; 5,123,487; and 5,127,473, each of which is incorporated by reference herein in its entirety.

In embodiments, the method of the present disclosure may be employed in a secondary cementing operation. In these embodiments, data sensors are mixed with a sealant composition (e.g., a secondary cement slurry) at block 102 of FIG. 1 and subsequent or during positioning and hardening of the cement, the sensors are interrogated to monitor the performance of the secondary cement in an analogous manner to the incorporation and monitoring of the data sensors in primary cementing methods disclosed hereinabove. For example, the elastomer-coated sensors may be used to verify that the secondary sealant is functioning properly and/or to monitor its long-term integrity.

In embodiments, the methods of the present disclosure are utilized for monitoring cementitious sealants (e.g., hydraulic cement), non-cementitious (e.g., polymer, latex or resin systems), or combinations thereof comprising one or more elastomer-coated sensors, which may be used in primary, secondary, or other sealing applications. For example, expandable tubulars such as pipe, pipe string, casing, liner, or the like are often sealed in a subterranean formation. The expandable tubular (e.g., casing) is placed in the wellbore, a sealing composition is placed into the wellbore, the expandable tubular is expanded, and the sealing composition is allowed to set in the wellbore. For example, after expandable casing is placed downhole, a mandrel may be run through the casing to expand the casing diametrically, with expansions up to 25% possible. The expandable tubular may be placed in the wellbore before or after placing the sealing composition in the wellbore. The expandable tubular may be expanded before, during, or after the set of the sealing composition. When the tubular is expanded during or after the set of the sealing composition, resilient compositions will remain competent due to their elasticity and compressibility. Additional tubulars may be used to extend the wellbore into the subterranean formation below the first tubular as is known to those of skill in the art. Sealant compositions and methods of using the compositions with expandable tubulars are disclosed in U.S. Pat. Nos. 6,722,433 and 7,040,404 and U.S. Patent Pub. No. 2004/0167248, each of which is incorporated by reference herein in its entirety. In expandable tubular embodiments, the sealants may comprise compressible hydraulic cement compositions and/or non-cementitious compositions.

Compressible hydraulic cement compositions (for example, compressible foamed sealants) have been developed which remain competent (continue to support and seal the pipe) when compressed, and such compositions may comprise sensors coated with an elastomer. The sealant composition is placed in the annulus between the wellbore and the pipe or pipe string, the sealant composition is allowed to harden into an impermeable mass, and thereafter, the expandable pipe or pipe string is expanded whereby the hardened sealant composition is compressed, as is the elastomer coating of the sensors within the sealant composition. In embodiments, the compressible foamed sealant comprises a hydraulic cement, a rubber latex, a rubber latex stabilizer, a gas and a mixture of foaming and foam stabilizing surfactants. Suitable hydraulic cements include, but are not limited to, Portland cement and calcium aluminate cement.

Often, non-cementitious resilient sealants with comparable strength to cement, but greater elasticity and compressibility, are required for cementing expandable casing. In embodiments, these sealants comprise polymeric sealing compositions, and such polymeric sealing compositions may be mixed with elastomer-coated sensors. In an embodiment, the sealant comprises a polymer and a metal containing compound. In embodiments, the polymer comprises copolymers, terpolymers, and interpolymers. The metal-containing compounds may comprise zinc, tin, iron, selenium magnesium, chromium, or cadmium. The compounds may be in the form of an oxide, carboxylic acid salt, a complex with dithiocarbamate ligand, or a complex with mercaptobenzothiazole ligand. In embodiments, the sealant comprises a mixture of latex, dithio carbamate, zinc oxide, and sulfur.

In embodiments, the methods of the present disclosure comprise adding elastomer-coated data sensors to a sealant to be used behind expandable casing to monitor the integrity of the sealant upon expansion of the casing and during the service life of the sealant. In this embodiment, the sensors may comprise sensors (e.g., MEMS sensors) capable of measuring one or more parameters, for example, expansion or swelling of the elastomer, compression of the elastomer, the presence of hydrocarbon, moisture, temperature change, or combinations thereof. If the sealant develops cracks, the cracks may be detected by expansion or compression of the elastomer-coated sensors. Water influx in the crack may be detected via, for example, moisture and/or temperature indication. Hydrocarbon influx in the crack may be detected via, for example, elastomer swelling and/or temperature indication.

In an embodiment, the elastomer-coated sensors are added to one or more wellbore servicing compositions used or placed downhole in drilling or completing a monodiameter wellbore as disclosed in U.S. Pat. No. 7,066,284 and U.S. Patent Pub. No. 2005/0241855, each of which is incorporated by reference herein in its entirety. In an embodiment, the elastomer-coated sensors are included in a chemical casing composition used in a monodiameter wellbore. In another embodiment, the elastomer-coated sensors are included in wellbore servicing compositions (e.g., sealants) used to place expandable casing or tubulars in a monodiameter wellbore. Examples of chemical casings are disclosed in U.S. Pat. Nos. 6,702,044; 6,823,940; and 6,848,519, each of which is incorporated herein by reference in its entirety.

In one embodiment, the elastomer-coated sensors are used to gather wellbore servicing composition (e.g., sealant) data and monitor the long-term integrity of the composition (e.g., sealant) placed in a wellbore, for example a wellbore for the recovery of natural resources such as water or hydrocarbons or an injection well for disposal or storage. In an embodiment, data/information gathered and/or derived from the elastomer-coated sensors in the composition (e.g., a downhole wellbore sealant) comprises at least a portion of the input and/or output to into one or more calculators, simulations, or models used to predict, select, and/or monitor the performance of wellbore sealant compositions over the life of a well. Such models and simulators may be used to select a composition comprising elastomer-coated sensors for use in a wellbore. After placement in the wellbore, the elastomer-coated sensors may provide data that can be used to refine, recalibrate, or correct the models and simulators. Furthermore, the elastomer-coated sensors can be used to monitor and record the downhole conditions that the sealant is subjected to, and sealant performance may be correlated to such long term data to provide an indication of problems or the potential for problems in the same or different wellbores. In various embodiments, data gathered from elastomer-coated sensors is used to select a sealant composition or otherwise evaluate or monitor such sealants, as disclosed in U.S. Pat. Nos. 6,697,738; 6,922,637; and 7,133,778, each of which is incorporated by reference herein in its entirety.

In an embodiment, the compositions and methodologies of this disclosure are employed via an operating environment that generally comprises a wellbore that penetrates a subterranean formation for the purpose of recovering hydrocarbons, storing hydrocarbons, injection of carbon dioxide, storage of carbon dioxide, disposal of carbon dioxide, and the like, and the elastomer-coated sensors may provide information as to a condition and/or location of the composition and/or the subterranean formation. For example, the elastomer-coated sensors may provide information as to a location, flow path/profile, volume, density, temperature, pressure, or a combination thereof of a hydrocarbon (e.g., natural gas stored in a salt dome) or carbon dioxide placed in a subterranean formation such that effectiveness of the placement may be monitored and evaluated, for example detecting leaks, determining remaining storage capacity in the formation, etc. In some embodiments, the compositions of this disclosure are employed in an enhanced oil recovery operation wherein a wellbore that penetrates a subterranean formation may be subjected to the injection of gases (e.g., carbon dioxide) so as to improve hydrocarbon recovery from said wellbore, and the elastomer-coated sensors may provide information as to a condition and/or location of the composition and/or the subterranean formation. For example, the elastomer-coated sensors may provide information as to a location, flow path/profile, volume, density, temperature, pressure, or a combination thereof of carbon dioxide used in a carbon dioxide flooding enhanced oil recovery operation in real time such that the effectiveness of such operation may be monitored and/or adjusted in real time during performance of the operation to improve the result of same.

Figure 4:
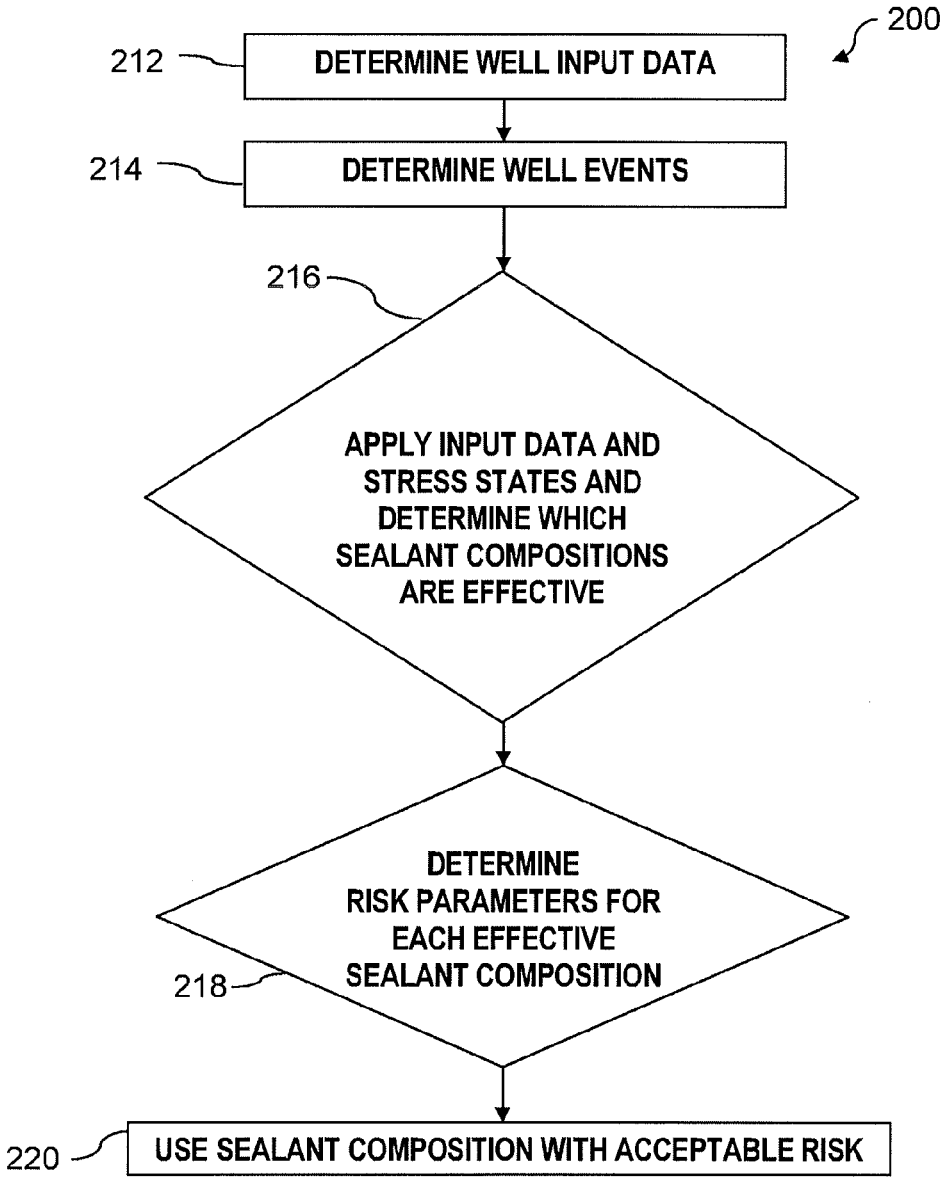
FIG. 4 is a flowchart of a method for selecting between a group of sealant compositions according to one embodiment of the present disclosure.

Referring to FIG. 4, a method 200 for selecting a sealant (e.g., a cementing composition) for sealing a subterranean zone penetrated by a wellbore according to the present embodiment basically comprises determining a group of effective compositions from a group of compositions given estimated conditions experienced during the life of the well, and estimating the risk parameters for each of the group of effective compositions. In an alternative embodiment, actual measured conditions experienced during the life of the well, in addition to or in lieu of the estimated conditions, may be used. Such actual measured conditions may be obtained for example via compositions (e.g., sealants) comprising sensors coated with an elastomer as described herein. Effectiveness considerations include concerns that the sealant composition be stable under downhole conditions of pressure and temperature, resist downhole chemicals, and possess the mechanical properties to withstand stresses from various downhole operations to provide zonal isolation for the life of the well.

In step 212, well input data for a particular well is determined. Well input data includes routinely measurable or calculable parameters inherent in a well, including vertical depth of the well, overburden gradient, pore pressure, maximum and minimum horizontal stresses, hole size, casing outer diameter, casing inner diameter, density of drilling fluid, desired density of sealant slurry for pumping, density of completion fluid, and top of sealant. As will be discussed in greater detail with reference to step 214, the well can be computer modeled. In modeling, the stress state in the well at the end of drilling, and before the sealant slurry is pumped into the annular space, affects the stress state for the interface boundary between the rock and the sealant composition. Thus, the stress state in the rock with the drilling fluid is evaluated, and properties of the rock such as Young's modulus, Poisson's ratio, and yield parameters are used to analyze the rock stress state. These terms and their methods of determination are well known to those skilled in the art. It is understood that well input data will vary between individual wells. In an alternative embodiment, well input data includes data that is obtained via compositions comprising a sealant and elastomer-coated sensors as described herein.

In step 214, the well events applicable to the well are determined. For example, cement hydration (setting) is a well event. Other well events include pressure testing, well completions, hydraulic fracturing, hydrocarbon production, fluid injection, perforation, subsequent drilling, formation movement as a result of producing hydrocarbons at high rates from unconsolidated formation, and tectonic movement after the sealant composition has been pumped in place. Well events include those events that are certain to happen during the life of the well, such as cement hydration, and those events that are readily predicted to occur during the life of the well, given a particular well's location, rock type, and other factors well known in the art. In an embodiment, well events and data associated therewith may be obtained via compositions comprising a sealant and elastomer-coated sensors as described herein.

Each well event is associated with a certain type of stress, for example, cement hydration is associated with shrinkage, pressure testing is associated with pressure, well completions, hydraulic fracturing, and hydrocarbon production are associated with pressure and temperature, fluid injection is associated with temperature, formation movement is associated with load, and perforation and subsequent drilling are associated with dynamic load. As can be appreciated, each type of stress can be characterized by an equation for the stress state (collectively "well event stress states"), as described in more detail in U.S. Pat. No. 7,133,778 which is incorporated herein by reference in its entirety.

In step 216, the well input data, the well event stress states, and the sealant data are used to determine the effect of well events on the integrity of the sealant sheath during the life of the well for each of the sealant compositions. The sealant compositions that would be effective for sealing the subterranean zone and their capacity from its elastic limit are determined. In an alternative embodiment, the estimated effects over the life of the well are compared to and/or corrected in comparison to corresponding actual data gathered over the life of the well via compositions comprising a sealant and elastomer-coated sensors as described herein. Step 216 concludes by determining which sealant compositions would be effective in maintaining the integrity of the resulting cement sheath for the life of the well.

In step 218, parameters for risk of sealant failure for the effective sealant compositions are determined. For example, even though a sealant composition is deemed effective, one sealant composition may be more effective than another. In one embodiment, the risk parameters are calculated as percentages of sealant competency during the determination of effectiveness in step 216. In an alternative embodiment, the risk parameters are compared to and/or corrected in comparison to actual data gathered over the life of the well via compositions comprising a sealant and the elastomer-coated sensors as described herein.

Step 218 provides data that allows a user to perform a cost benefit analysis. Due to the high cost of remedial operations, it is important that an effective sealant composition is selected for the conditions anticipated to be experienced during the life of the well. It is understood that each of the sealant compositions has a readily calculable monetary cost. Under certain conditions, several sealant compositions may be equally efficacious, yet one may have the added virtue of being less expensive. Thus, it should be used to minimize costs. More commonly, one sealant composition will be more efficacious, but also more expensive. Accordingly, in step 220, an effective sealant composition with acceptable risk parameters is selected given the desired cost. Furthermore, the overall results of steps 200-220 can be compared to actual data that is obtained via compositions comprising a sealant composition and the elastomer-coated sensors as described herein, and such data may be used to modify and/or correct the inputs and/or outputs to the various steps 200-220 to improve the accuracy of same.

As discussed above and with reference to FIG. 2, wipers are often utilized during conventional primary cementing to force cement slurry out of the casing. The wiper plug also serves another purpose: typically, the end of a cementing operation is signaled when the wiper plug contacts a restriction (e.g., casing shoe) inside the casing 20 at the bottom of the string. When the plug contacts the restriction, a sudden pressure increase at a pump of wellbore servicing system 30 is registered. In this way, it can be determined when the cement has been displaced from the casing 20 and fluid flow returning to the surface via casing annulus 26 stops.

In reverse circulation cementing, it is also necessary to correctly determine when cement slurry completely fills the annulus 26. Continuing to pump cement into annulus 26 after cement has reached the far end of annulus 26 forces cement into the far end of casing 20, which could incur lost time if cement must be drilled out to continue drilling operations.

The methods disclosed herein may be utilized to determine when cement slurry has been appropriately positioned downhole. Furthermore, as discussed hereinbelow, the methods of the present disclosure may additionally comprise using a sensor coated with an elastomer to actuate a valve or other mechanical means to close and prevent cement from entering the casing upon determination of completion of a cementing operation.

Figure 3:
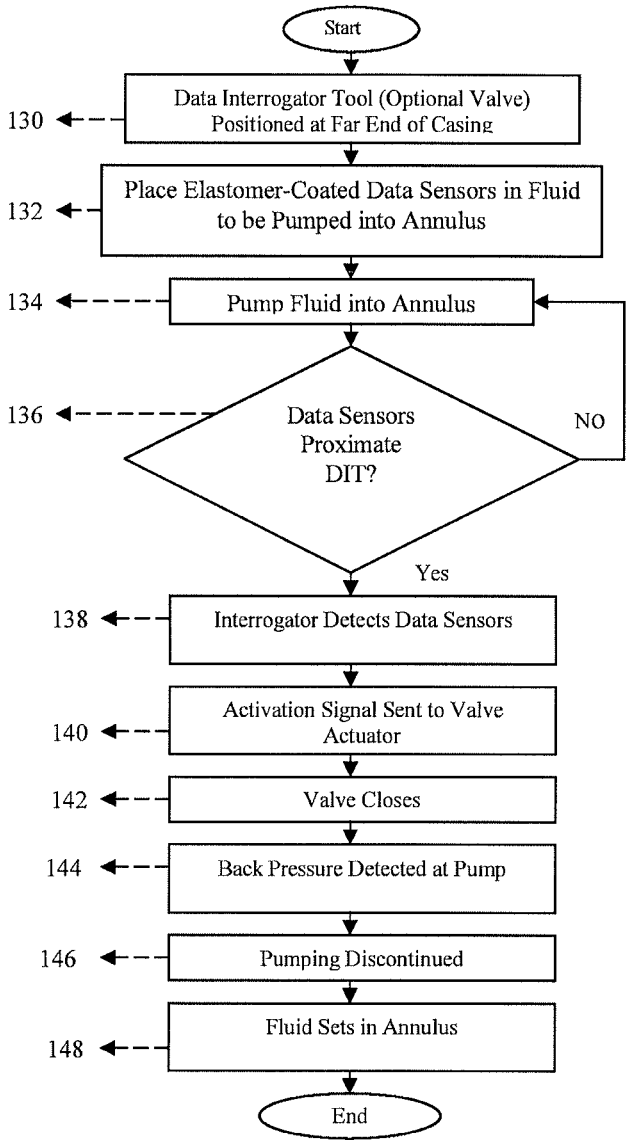
FIG. 3 is a flowchart detailing a method for determining when a reverse cementing operation is complete and for subsequent optional activation of a downhole tool.

The way in which the method of the present disclosure may be used to signal when cement is appropriately positioned within annulus 26 will now be described within the context of a reverse circulation cementing operation. FIG. 3 is a flowchart of a method for determining completion of a cementing operation and optionally further actuating a downhole tool upon completion (or to initiate completion) of the cementing operation. This description will reference the flowchart of FIG. 3, as well as the wellbore depiction of FIG. 2.

At block 130, a data interrogator tool as described hereinabove is positioned at the far end of casing 20. In an embodiment, the data interrogator tool is incorporated with or adjacent to a casing shoe positioned at the bottom end of the casing and in communication with operators at the surface. At block 132, elastomer-coated sensors are added to a wellbore servicing fluid (e.g., drilling fluid, completion fluid, cement slurry, spacer fluid, displacement fluid, etc.) to be pumped into annulus 26. At block 134, cement slurry is pumped into annulus 26. In an embodiment, the elastomer-coated sensors may be placed in substantially all of the cement slurry pumped into the wellbore. In an alternative embodiment, the elastomer-coated sensors may be placed in a leading plug or otherwise placed in an initial portion of the cement to indicate a leading edge of the cement slurry. In an embodiment, elastomer-coated sensors are placed in leading and trailing plugs to signal the beginning and end of the cement slurry. While cement is continuously pumped into annulus 26, at decision 136, the data interrogator tool is attempting to detect whether the data sensors are in communicative proximity with the data interrogator tool. As long as no data sensors are detected, the pumping of additional cement into the annulus continues. When the data interrogator tool detects the sensors at block 138 indicating that the leading edge of the cement has reached the bottom of the casing, the interrogator sends a signal to terminate pumping. The cement in the annulus is allowed to set and form a substantially impermeable mass which physically supports and positions the casing in the wellbore and bonds the casing to the walls of the wellbore in block 148.

If the fluid of block 130 is the cement slurry, elastomer-coated (e.g., MEMS-based) data sensors are incorporated within the set cement, and parameters of the cement (e.g., cracks, temperature, pressure, ion concentration, stress, strain, presence of hydrocarbon, etc.) can be monitored during placement and for the duration of the service life of the cement according to methods disclosed hereinabove. Alternatively, the elastomer-coated data sensors may be added to an interface fluid (e.g., spacer fluid or other fluid plug) introduced into the annulus prior to and/or after introduction of cement slurry into the annulus.

The method just described for determination of the completion of a primary wellbore cementing operation may further comprise the activation of a downhole tool. For example, at block 130, a valve or other tool may be operably associated with a data interrogator tool at the far end of the casing. This valve may be contained within float shoe 22, for example, as disclosed hereinabove. Again, float shoe 22 may contain an integral data interrogator tool, or may otherwise be coupled to a data interrogator tool. For example, the data interrogator tool may be positioned between casing 20 and float shoe 22. Following the method previously described and blocks 132 to 136, pumping continues as the data interrogator tool detects the presence or absence of data sensors in close proximity to the interrogator tool (dependent upon the specific method cementing method being employed, e.g., reverse circulation, and the positioning of the sensors within the cement flow). Upon detection of a determinative presence or absence of sensors in close proximity indicating the termination of the cement slurry, the data interrogator tool sends a signal to actuate the tool (e.g., valve) at block 140. At block 142, the valve closes, sealing the casing and preventing cement from entering the portion of casing string above the valve in a reverse cementing operation. At block 144, the closing of the valve at 142, causes an increase in back pressure that is detected at the wellbore servicing system 30. At block 146, pumping is discontinued, and cement is allowed to set in the annulus at block 148. In embodiments wherein data sensors have been incorporated throughout the cement, parameters of the cement (and thus cement integrity) can additionally be monitored during placement and for the duration of the service life of the cement according to methods disclosed hereinabove.

Improved methods of monitoring the condition from placement through the service lifetime of the wellbore servicing compositions disclosed herein provide a number of advantages. Such methods are capable of detecting changes in parameters in the wellbore servicing compositions described herein, such as integrity (e.g., cracks), density, present or absence of a fluid (e.g., hydrocarbon or water), moisture content, temperature, pH, and the concentration of ions (e.g., chloride, sodium, and potassium ions). Such methods provide this data for monitoring the condition of the wellbore servicing compositions from the initial quality control period during mixing and/or placement, through the compositions' useful service life, and through its period of deterioration and/or repair. Such methods also provide this data for monitoring the condition of compositions during drilling operations, completion operations, production operations, or combinations thereof. Such methods are cost efficient and allow determination of real-time data using sensors capable of functioning without the need for a direct power source (i.e., passive rather than active sensors), such that sensor size be minimal to maintain sealant strength and sealant slurry pumpability. The use of elastomer-coated sensors for determining wellbore characteristics or parameters may also be utilized in methods of pricing a well servicing treatment, selecting a treatment for the well servicing operation, and/or monitoring a well servicing treatment during real-time performance thereof, for example, as described in U.S. Patent Pub. No. 2006/0047527 A1, which is incorporated by reference herein in its entirety.

FIG. 5A schematically illustrates an embodiment of the wellbore servicing system 30 of FIG. 2. As can be seen in the embodiment of FIG. 5A, the wellbore servicing system 30 may comprise surface wellbore operating equipment (e.g., a first mixing tub 150, a second mixing tub 152, a first actuator 154, a second actuator 156, a mixing head 160, a first mixing paddle 162, a recirculation pump 164, a second mixing paddle 166, a mixture supply pump 168, a controller 170, flowlines configured to flow the wellbore servicing composition, or combinations thereof), one or more interrogators 180, 182, 184, 186, and a wellbore servicing composition (e.g., a wellbore servicing fluid comprising a cement slurry (e.g., hydraulic cement slurry), a non-cementitious sealant, a drilling fluid, a sealant, a fracturing fluid, a completion fluid, or combinations thereof) comprising a plurality of sensors (e.g., MEMS sensors 175, optionally elastomer-coated). In additional embodiments, the wellbore servicing system 30 may comprise components such as additional actuators, sensors (height sensor, flow sensor, weight sensor, pressure sensor, temperature sensor), and/or other surface operating equipment known in the art with the aid of this disclosure.

In embodiments, the system 30 may be located at the surface of a wellsite. In an embodiment, the system 30 is suitable, for example, for mixing a wellbore servicing composition in support of wellbore servicing operations, such as mixing cement for cementing casing into a wellbore. In additional or alternative embodiments, the system 30 is suitable for other mixing operations, for example, for mixing fracturing fluid in support of wellbore servicing operations, for example, a formation fracturing operation during well completion and/or production enhancement operations (see, e.g., the embodiment of the system of FIG. 5A and the description below).

The first actuator 154 and the second actuator 156 may be any of valves, screw feeders, augers, elevators, and other actuators known to those skilled in the art with the aid of this disclosure. The actuators 154 and/or 156 may be modulated by controlling a position or by controlling a rotation rate of the actuator 154 and/or 156. For example, if the actuator 154 and/or 156 is a valve, the valve may be modulated by varying the position of the valve. In another example, if the actuator 154 and/or 156 is a screw feeder, the screw feeder may be modulated by varying the rotational speed of the screw feeder. In another example, if the actuator 154 and/or 156 is an elevator, the elevator may be modulated by varying a linear speed of the elevator. In embodiments, the first actuator 154 may control the flow of a carrier fluid, for example water, into the first mixing tub 150. In embodiments, the second actuator 156 may control the flow of a dry material, for example, dry cement, proppants, and/or additive material, into the first mixing tub 150. In an embodiment, the carrier fluid and the dry material are flowed together in the mixing head 160 and flow out of the mixing head 160 into the first mixing tub 150. In an alternative embodiment, the mixing head 160 may be omitted from the system 100 and the first actuator 154 and the second actuator 156 may dispense materials directly into the first mixing tub 150. Additionally, in another embodiment, additional actuators (not shown) may be provided to control the introduction of other materials (e.g., additives, MEMS sensors) into the first mixing tub 150 and/or second mixing tub 152.

Mixing tubs 150 and 152 may comprise a mixer or blender (e.g., a cement slurry mixer). FIG. 5A shows the system 30 with two mixing tubs 150 and 152. In alternative embodiments, the system 30 may comprise one mixing tub 150 (e.g., receiving mixing materials therein and flowing a wellbore servicing composition through mixture supply pump 168), or more than one mixing tub (e.g., arranged in series and/or parallel). As can be seen in FIG. 5A, the first mixing tub 150 may be positioned and/or configured to flow the wellbore servicing composition into the second mixing tub 152. In an embodiment, the first mixing tub 150 comprises a weir over which the wellbore servicing composition overflows from the first mixing tub 150 into the second mixing tub 152 (indicated by the dotted lines in FIG. 5A). In an additional or alternative embodiment, the first mixing tub 150 may be configured to flow the wellbore servicing composition into the second mixing tub 152 via piping and/or conduits. In an embodiment, the first mixing tub 150 may comprise a mixing paddle 162, and the second mixing tub 152 may comprise a mixing paddle 166. In additional or alternative embodiments, the first mixing tub 150 and/or the second mixing tub 152 may comprise another mechanism for mixing and/or blending the wellbore servicing composition. The wellbore servicing composition is delivered from the second mixing tub 152 by the mixture supply pump 168, to the wellbore or other surface wellbore operating equipment, for example, equipment for cementing a casing in a wellbore. For example, the surface wellbore operating equipment may place a cement slurry in a wellbore in a subterranean formation by pumping the cement slurry down an inside of a casing and flowing the cement slurry out of the casing and into an annulus between the casing and the subterranean formation.

In an embodiment, the system 30 comprises a plurality of sensors coupled with surface wellbore operating equipment. For example, a flow rate sensor (e.g., a turbine-type flow rate meter) may be positioned between the first actuator 154 and the mixing head 160 to sense the flow rate through the first actuator 154. In another example, one or more weight sensors (e.g., a load cell positioned proximate the first mixing tub 150, second mixing tub 152, or both) may sense a weight of the first mixing tub 150, the second mixing tub 152, portions thereof, or combinations thereof. In another example, a height sensor may sense a height of the wellbore servicing composition in the second mixing tub 152.

In an embodiment, the wellbore servicing composition comprises one or more sensors (e.g., MEMS sensors 175). FIG. 5A shows the MEMS sensors 175 may be added to the wellbore servicing composition in the second mixing tub 152 in FIG. 5A; however, MEMS sensors 175 may be added to the wellbore servicing composition at any suitable point in the system 30, e.g., in first mixing tub 150, through an actuator (e.g., actuator 154 and/or 156 and/or other actuator), by manual admixing, or by any other method known to those skilled in the art with the aid of this disclosure (e.g., pre-mixing as described in the method below). In an embodiment, the sensors (e.g., MEMS sensors 175 optionally comprising an elastomer coating) are integrated or coupled with a radio-frequency-identification (RFID) tag. In an embodiment, the sensors (e.g., MEMS sensors 175) may comprise from about 0.01 to about 5 weight percent of the wellbore servicing composition. In an embodiment, the sensors (e.g., MEMS sensors 175 are approximately 0.01 $mm^2$ to approximately 10 $mm^2$ in size.

The system 30 may comprise one or more interrogators 180, 182, 184 and 186. The positioning of interrogators 180, 182, 184, and 186 is shown by way of example, and it is contemplated that various embodiments may have one interrogator or more than one interrogator positioned in communicative proximity (e.g., a distance of about 0.1 meter to about 10 meters) with one or more of the MEMS sensors. For example, an interrogator of the wellbore servicing system 30 may be positioned on, within, about, around, in proximity to, or combinations thereof of surface wellbore operating equipment of the wellbore servicing system 30 at the surface (e.g., surface 16 of FIG. 2) of the wellsite. In an embodiment, an interrogator 180 may be attached to the wall of the wellbore operating equipment (e.g., second mixing tub 152); additionally or alternatively, an interrogator 182 may be positioned within the wellbore operating equipment (e.g., second mixing tub 152); additionally or alternatively, an interrogator 184 may be positioned around a wellbore operating equipment (e.g., a flowline connecting the second mixing tub 152 and the mixture supply pump 168); additionally or alternatively, an interrogator 186 may be positioned within or around a wellbore operating equipment (e.g., a flowline 158 flowing from the mixture supply pump 168 to the wellbore). In embodiments, a recycle line (e.g., flowing from flowline 158 or a flowline upstream of mixture supply pump 168) may be included in the system 30 such that a non-uniformly mixed composition (additionally or alternative, a composition which is not in spec) may be returned to a mixer (e.g., mixing tub 150 and/or mixing tub 152) for further mixing and/or adjustment.

The placement of interrogator 180 demonstrates that interrogators disclosed herein may be positioned on surface wellbore operating equipment near the wellbore servicing composition comprising MEMS sensors 175 but not within the composition. The placement of interrogator 182 demonstrates that interrogators disclosed herein may be positioned on an interior surface of a wellbore operating equipment and within the composition. The placement of interrogator 184 demonstrates that interrogators disclosed herein may be positioned around (e.g., on an outer surface) of surface wellbore operating equipment and not within the composition. The placement of interrogator 186 demonstrates that interrogators disclosed herein may be position around (e.g., on an outer surface) of surface wellbore operating equipment and within the composition. Such configurations are contemplated for the embodiment disclosed in FIG. 5A.

The interrogator (e.g., one or more of interrogators 180, 182, 184, 186) of wellbore servicing system 30 may be integrated with a radio-frequency (RF) energy source and the MEMS sensors 175 may be passively energized via an FT antenna which picks up energy from the RF energy source. The RF energy source may comprise a frequency of 125 kHz, 915 MHz, 13.5 MHz, 2.4 GHz, or combinations thereof. In an embodiment, the interrogator (e.g., one or more of interrogators 180, 182, 184, 186) may comprise a mobile transceiver electromagnetically coupled with the one or more of the MEMS sensors 175.

The interrogator (e.g., one or more of interrogators 180, 182, 184, 186) of wellbore servicing system 30 may retrieve data regarding one or more parameters sensed by the MEMS sensors 175, for example, a location of one or more of the MEMS sensors 175 (e.g., in the wellbore servicing composition in the second mixing tub 152 as shown in FIG. 5A), a condition of mixing, a composition component concentration, a density, a dispersion of the sensors (e.g., MEMS sensors) in the wellbore servicing composition at the surface of the wellsite, or combinations thereof. In embodiments, the interrogator may activate and receive data from one or more sensors (e.g., MEMS sensors 175) in the wellbore servicing composition at the surface of the wellsite (e.g., within second mixing tub 152). In FIG. 5A, it can be seen that MEMS sensors 175 are uniformly dispersed in the wellbore servicing composition of second mixing tub 152.

The interrogator (e.g., one or more of interrogators 180, 182, 184, 186) of wellbore servicing system 30 may communicate data to a computer (e.g., controller 170) whereby data sensor position (e.g., location) may indicate a mixing condition (e.g., uniformity of mixing), a concentration of a component in the wellbore servicing composition, a density of the wellbore servicing composition, a dispersion of the sensors (e.g., MEMS sensors) in the wellbore servicing composition at the surface of the wellsite, or combinations thereof. The computer may analyze sensed parameters for values, changes in value, trends, expected values, etc. For example, such data may reveal conditions that may be adverse to a well-mixed composition (e.g., a drilling fluid, a spacer fluid, a sealant (e.g. cement slurry-hydraulic or non-cementitious), a fracturing fluid, a gravel pack fluid, or a completion fluid).

In embodiments, the system 30 may further comprise an access window (e.g., a window which comprises a material such as polycarbonate or other material suitable for use under the conditions of the wellbore servicing system 30) of surface wellbore operating equipment which is coupled with an interrogator (e.g., interrogator 180, 182, 184, and/or 186). The access window is suitable for facilitating the interrogation of the MEMS sensors within the surface wellbore operating equipment.

The controller 170 may be used to control a condition of the wellbore servicing composition being mixed in the system 30, e.g., via controlled parameters such as feed flow rate, mixing speed, recycle flow rate, supply flow rate, and other conditions known to those skilled in the art with the aid of this disclosure. In an embodiment, the controller 170 may be configured to control at least one of surface wellbore operating equipment of the system 30 to deliver a wellbore servicing composition having suitable properties at a desired flow rate, e.g., at any point in the system 30 such as the output of the mixture supply pump 168. For example, the controller 170 may control the first actuator 154, the second actuator 156, the mixing head 160, the first mixing paddle 162, the recirculation pump 164, the second mixing paddle 166, the mixture supply pump 168, or combinations thereof, to deliver a wellbore servicing composition (e.g., a cement slurry) having specified conditions (e.g., uniformly dispersed MEMS sensors) at a specified flowrate to a wellbore.

In embodiments, the controller 170 may receive the sensed parameters and/or conditions from the MEMS sensors 175. From these sensed parameters and/or conditions, the controller 170 may determine a parameter and/or condition of the wellbore servicing composition in the system 30 (e.g., a density, uniformity of mixing, etc., e.g., based on a location of one or more of the MEMS sensors 175) and use control commands to adjust a condition and/or parameter (e.g., a location of the MEMS sensors 175, a condition of mixing, a composition component concentration, a density, a dispersion of the sensors (e.g., MEMS sensors) in the wellbore servicing composition at the surface of the wellsite, or combinations thereof) of the wellbore servicing composition, for example, by controlling the surface wellbore operating equipment (e.g., the first actuator 154, the second actuator 156, the mixing head 160, the first mixing paddle 162, the recirculation pump 164, the second mixing paddle 166, the mixture supply pump 168, or combinations thereof).

FIG. 5A schematically illustrates another embodiment of the wellbore servicing system 30 of FIG. 2. As shown in the embodiment of FIG. 5B, the wellbore servicing system 30 may comprise one or more surface wellbore operating equipment (e.g., a composition treatment system 210, one or more storage vessels (e.g., storage vessels 310, 312, 314, and 320), bulk mixers (e.g., gel blender 240 and sand blender 242), a wellbore services manifold trailer 250, one or more high-pressure (HP) pumps 270, one or more flowline 342, 260, 280, 290 or other flowlines downstream of the first bulk mixer (e.g., gel blender 240), a conduit leading to the wellbore (e.g., conduit 190), other surface wellbore operating equipment known to those of skill in the art with the aid of this disclosure, or combinations thereof), a wellbore servicing composition (e.g., a drilling fluid, a spacer fluid, a sealant (e.g. cement slurry-hydraulic or non-cementitious), a fracturing fluid, a gravel pack fluid, a completion fluid, or combinations thereof) comprising sensors (e.g., MEMS sensors) located within the surface wellbore operating equipment, and one or more interrogators placed in communicative proximity (e.g., a distance of about 0.1 meter to about 10 meters) with the sensors. The system 30 may further comprise an access window (e.g., a window which comprises a material such as polycarbonate or other material suitable for use under the conditions of the wellbore servicing system 30) of a surface wellbore operating equipment and coupled with an interrogator (discussed below). The access window is suitable for facilitating the interrogation of the MEMS sensors within the surface wellbore operating equipment. In FIG. 5B, the system 30 may further comprise a recycle flowline which recycles a non-conforming wellbore servicing composition through the wellbore servicing system 30 so that the composition can be adjusted to conform with a desired characteristic, according to the method described herein below, before placing the wellbore servicing composition in a wellbore.

In embodiments, the system 30 of FIG. 5A may be located at the surface of a wellsite. In an embodiment, the wellbore servicing system 30 of FIG. 5A may be configured to communicate a mixed wellbore servicing composition into the wellbore (e.g., wellbore 18 of FIG. 2) at a rate and/or pressure suitable for the performance of a given wellbore servicing operation. For example, in an embodiment where the wellbore servicing system 30 is configured for the performance of a stimulation operation (e.g., a perforating and/or fracturing operation), the wellbore servicing system 30 of FIG. 5A may be configured to deliver a wellbore servicing composition (e.g., a perforating and/or fracturing fluid) at a rate and/or pressure sufficient for initiating, forming, and/or extending a fracture into a hydrocarbon-bearing formation (e.g., subterranean formation 14 of FIG. 2 or a portion thereof).

In operation of the system 30, water from the composition treatment system 210 is introduced, either directly or indirectly (e.g., via treated water vessel 310), into the gel blender 240 and then into the sand blender 242 where the water is mixed with various other components and/or additives to form a wellbore servicing composition. The wellbore servicing composition is introduced into the wellbore services manifold trailer 250, which is in fluid communication with the one or more HP pumps 270, and then introduced into the conduit 190. The fluid communication between two or more components of the wellbore servicing system 30 may be provided by any suitable flowline or conduit.

Persons of ordinary skill in the art with the aid of this disclosure will appreciate that the flowlines described herein (e.g., flowlines of FIGS. 5A and 5B) may include various configurations of piping, tubing, etc., that are fluidly connected, for example, via flanges, collars, welds, etc. These flowlines may include various configurations of pipe tees, elbows, and the like. These flowlines fluidly connect the various surface wellbore operating equipment described above.

In an embodiment, the blender 240 may be configured to mix solid and fluid components to form wellbore servicing composition. In the embodiment of FIG. 5B, gelling agent from a storage vessel 312, treated water from intermediate storage vessel 310, and additives from a storage vessel 320 may be fed into the blender 240 via flowlines 322, 340 and 350, respectively. Alternatively, water treated by fluid treatment system 210 may be fed directly into gel blender 240. In an embodiment, the gel blender 240 may comprise any suitable type and/or configuration of blender. For example, the gel blender 240 may be an Advanced Dry Polymer (ADP) blender and the additives may be dry blended and dry fed into the gel blender 240. In an alternative embodiment, additives may be pre-blended with water, for example, using a GEL PRO blender, which is a commercially available from Halliburton Energy Services, Inc., to form a liquid gel concentrate that may be fed into the gel blender 240. In the embodiment of FIG. 5B, fluid from gel blender 240 and sand/proppant from a storage vessel 314 may be fed into sand blender 242 via flowlines 342 and 330, respectively. In alternative embodiments, sand or proppant, water, and/or additives may be premixed and/or stored in a storage tank before introduction into the wellbore services manifold trailer 250. In the embodiment of FIG. 5A, the sand blender 242 is in fluid communication with a wellbore services manifold trailer 250 via a flowline 260.

In the embodiment of FIG. 5A, the wellbore servicing composition may be introduced into the wellbore services manifold trailer 250 from the sand blender 242 via flowline 260. As used herein, the term "wellbore services manifold trailer" may include a truck and/or trailer comprising one or more manifolds for receiving, organizing, pressurizing, and/or distributing wellbore servicing compositions during wellbore servicing operations. Alternatively, a wellbore servicing manifold need not be contained on a trailer, but may comprise any suitable configuration. In the embodiment illustrated by FIG. 5B, the wellbore services manifold trailer 250 is coupled to eight high pressure (HP) pumps 270 via outlet flowlines 280 and inlet flowlines 290. In alternative embodiments, however, any suitable number, configuration, and/or type of pumps may be employed in a wellbore servicing operation. The HP pumps 270 may comprise any suitable type of high-pressure pump, a nonlimiting example of which is a positive displacement pump. Outlet flowlines 280 are outlet lines from the wellbore services manifold trailer 250 that supply fluid to the HP pumps 270. Inlet flowlines 290 are inlet lines from the HP pumps 270 that supply fluid to the wellbore services manifold trailer 250. In an embodiment, the HP pumps 270 may be configured to pressurize the wellbore servicing composition to a pressure suitable for delivery into the wellbore. For example, the HP pumps 270 may be configured to increase the pressure of the wellbore servicing composition to a pressure of about 10,000 psi; alternatively, about 15,000 psi; alternatively, about 20,000 psi or higher.

In an embodiment, the wellbore servicing composition may be reintroduced into the wellbore services manifold trailer 250 from the HP pumps 270 via inlet flowlines 290, for example, such that the wellbore servicing composition may have a suitable total fluid flow rate. One of skill in the art with the aid of this disclosure will appreciate that one or more of the surface wellbore servicing equipment, for example, as disclosed herein, may be sized and/or provided in a number so as to achieve a suitable pressure and/or flow rate of the wellbore servicing composition to the wellbore. For example, the wellbore servicing composition may be provided from the wellbore services manifold trailer 250 via flowline 190 to the wellbore at a total flow rate of between about 1 BPM to about 200 BPM, alternatively from between about 50 BPM to about 150 BPM, alternatively about 100 BPM.

As indicated above, the system 30 of FIG. 5A may comprise a wellbore servicing composition. In embodiments, the wellbore servicing composition may comprise a wellbore servicing fluid (e.g., a hydraulic cement slurry or non-cementitious sealant). In additional or alternative embodiments, the wellbore servicing composition may be formulated as a drilling fluid, a spacer fluid, a sealant, a fracturing fluid, a gravel pack fluid, a completion fluid, or combinations thereof. In additional or alternative embodiments, the wellbore servicing composition may comprise one or more sensors placed therein. The sensors (e.g., MEMS sensors) may be added to the wellbore servicing composition at any point in the system 30 suitable for adding such sensors. For example, MEMS sensors may be added to surface wellbore operating equipment via an actuator of the type described in FIG. 5A, by manual admixing, or by any other method known to those skilled in the art with the aid of this disclosure (e.g., pre-mixing as described in the method below).

In an embodiment, the sensors (e.g., MEMS sensors optionally comprising an elastomer coating) are integrated or coupled with a radio-frequency-identification (RFID) tag. In embodiments, the sensors contained are ultra-small, e.g., 3 $mm^2$, such that the sensors are pumpable in the disclosed wellbore servicing compositions. In embodiments, the MEMS device of the sensor may be approximately 0.01 $mm^2$ to 1 $mm^2$, alternatively 1 $mm^2$ to 3 $mm^2$, alternatively 3 $mm^2$ to 5 $mm^2$, or alternatively 5 $mm^2$ to 10 $mm^2$. In embodiments, the sensors may be approximately 0.01 $mm^2$ to 10 $mm^2$. In an embodiment, the composition comprises an amount of sensors effective to measure one or more desired parameters. In an embodiment, the sensors may be present in the disclosed wellbore servicing compositions in an amount of from about 0.001 to about 10 weight percent. Alternatively, the sensors may be present in the disclosed wellbore servicing compositions in an amount of from about 0.01 to about 5 weight percent.

The wellbore servicing system 30 may further comprise one or more interrogators which are placed in a part of the wellbore servicing system 30 as indicated in FIG. 5A by the box 360 having dashed lines (e.g., coupled with one or more of blenders 240, 242, one or more of flowlines 342, 260, 280, 290, conduit 190, one or more of HP pumps 270, or combinations thereof). An interrogator of the wellbore servicing system 30 may be positioned on, within, about, around, in proximity to, or combinations thereof of surface wellbore operating equipment of the wellbore servicing system 30 at the surface (e.g., surface 16 of FIG. 2) of the wellsite. In an embodiment, the interrogator is attached to the surface wellbore operating equipment.

In embodiments, the interrogator may retrieve data regarding one or more parameters (e.g., a location, a condition of mixing, a composition component concentration, a density, a dispersion of the sensors (e.g., MEMS sensors) in the wellbore servicing composition at the surface of the wellsite, or combinations thereof) sensed by the sensors (e.g., MEMS sensors). In embodiments, the interrogator may activate and receive data form one or more sensors (e.g., MEMS sensors) in the wellbore servicing composition at the surface of the wellsite (e.g., within surface wellbore operating equipment). The interrogator of wellbore servicing system 30 may communicate data to a computer (e.g., a controller 370) whereby data sensor position (e.g., location) may indicate a mixing condition (e.g., uniformity of mixing), a concentration of a component in the wellbore servicing composition, a density of the wellbore servicing composition, a dispersion of the sensors (e.g., MEMS sensors) in the wellbore servicing composition at the surface of the well site, or combinations thereof.

The interrogator may comprise a transceiver electromagnetically coupled with the sensors. In an embodiment, the interrogator is integrated with a radio-frequency (RF) energy source and the sensors are passively energized via an FT antenna which picks up energy from the RF energy source, and wherein the RF energy source comprises a frequency of 125 kHz, 915 MHz, 13.5 MHz, 2.4 GHz, or combinations thereof.

In an embodiment, the controller 370 may be configured to control at least one surface wellbore operating equipment of the system 30 of FIG. 5A to deliver a wellbore servicing composition having suitable properties at a controlled flow rate, e.g., at any point in the system 30 such as HP pumps 270. For example, the controller 170 may control the water treatment system 210, one or more storage vessels (such as storage vessels 310, 312, 314, and 320), bulk mixers such as gel blender 240 and sand blender 242, the wellbore services manifold trailer 250, one or more high-pressure (HP) pumps 270, or combinations thereof, to deliver a wellbore servicing composition (e.g., a fracturing fluid) having specified conditions at a specified flowrate to a wellbore, e.g., via conduit 190.

In embodiments, the controller 370 may be used to control a condition of the wellbore servicing composition being mixed in the system 30, e.g., via controlled parameters such as feed flow rate, mixing speed, recycle flow rate, supply flow rate, and other conditions known to those skilled in the art with the aid of this disclosure. The controller 370 may control the mixing conditions of the surface wellbore equipment (e.g., gel blender 240, sand blender 242), including time period, agitation method, pressure, and temperature of the wellbore servicing composition in the bulk mixer, to produce a uniformly-mixed wellbore servicing composition having a controlled composition, density, viscosity, or combinations thereof.

In embodiments, the controller 370 may receive the sensed parameters and/or conditions from the MEMS sensors placed within the wellbore servicing composition. From these sensed parameters and/or conditions, the controller 370 may determine a parameter and/or condition of the wellbore servicing composition in the system 30 (e.g., a density, uniformity of mixing, a density, a component concentration, a dispersion of the sensors, e.g., based on a location of one or more of the MEMS sensors) and use control commands to adjust a condition and/or parameter (e.g., a location of the MEMS sensors) of the wellbore servicing composition, for example, by controlling the surface wellbore operating equipment (e.g., composition treatment system 210, one or more storage vessels (such as storage vessels 310, 312, 314, and 320), bulk mixers such as gel blender 240 and sand blender 242, the wellbore services manifold trailer 250, one or more high-pressure (HP) pumps 270, or combinations thereof).

In embodiments, one or more MEMS sensors placed within the wellbore servicing composition may be assigned a unique identifier. When a MEMS sensor having a unique identifier sends data, the data may include the unique identifier alone or in combination with other data.

A unique identifier may be used to track a specific MEMS sensor as it travels through the wellbore. For example, downhole tools, sensors, antennas, or other devices capable of receiving data from a MEMS sensor may be distributed along the wellbore and may receive data including a unique identifier from a MEMS sensor travelling through the wellbore. Based on the location of the downhole equipment device and the time at which the unique identifier is received by the reception device, the general path and velocity of the MEMS sensor may be determined. Alternatively or in addition to tracking through devices disposed in the wellbore, the MEMS sensor may include a self-locating system and provide data via the self-locating system that either directly provides the location of the MEMS sensor or can be used to calculate the location of the MEMS sensor. For example, the MEMS sensor may include an inertial system including one or more accelerometers and gyroscopes to determine one or more of the MEMS sensor's position, velocity, and acceleration. Since the MEMS sensor transmitting the unique identifier is part of a wellbore servicing composition, the travel undertaken by the MEMS sensor may be used as an indicator of how the fraction of the wellbore servicing composition containing the MEMS sensor is travelling through the wellbore.

In addition to the unique identifier, the data sent by the MEMS sensor may include other sensor readings. These readings may include, but are not limited to, pressure, temperature, pH, electrical conductivity, thermal conductivity, moisture, stress, and strain. In embodiments, the additional sensor data may be used with tracking information to determine downhole conditions at points throughout the wellbore. For example, sensor readings for a particular parameter obtained from a MEMS sensor being tracked through a wellbore may be used to generate a profile of the particular parameter through the wellbore. Sensor readings collected from subsequent MEMS sensors passed through the wellbore may be combined with the first MEMS sensor data in order to confirm, supplement, or otherwise refine the profile. In another example, since the position of MEMS sensors tracked through the wellbore is known, successive MEMS sensors passed through the wellbore may be used to periodically monitor conditions at a specific point within the wellbore.

In embodiments, MEMS sensors may be active sensors. Active MEMS sensors may transmit data independently and may eliminate the need for inserting an interrogator into the wellbore to activate the MEMS sensor and retrieve data. By actively transmitting data independent of interrogation, an active MEMS sensor may be used to collect data from the MEMS sensor in real-time and in wellbore locations that may be unreachable by an interrogator.

An active MEMS sensors may be configured to communicate data to devices in its proximity. These devices may include, but are not limited to, other active MEMS sensors, surface equipment, and downhole equipment. By receiving and retransmitting the active MEMS sensor data, the devices may be used to establish a communication network between the active MEMS sensor and one or more specific devices. For example, the active MEMS sensor may communicate data to a specific piece of surface equipment via any of one or more MEMS sensors, one or more pieces of downhole equipment, and one or more pieces of surface equipment, whether taken alone or in combination. Communication between devices may occur wirelessly or by wired connections and may use any suitable communications protocol.

An active MEMS sensor may include an on-board power source. The on-board power source may comprise one or both of an energy storage device and an energy generating device. An energy storage device may include, for example, a battery or fuel-cell, and may store energy for use by the active MEMS sensor as it passes through the wellbore. In contrast, an energy generating device may generate energy as the MEMS sensor passes through the wellbore.

An energy storage device of an active MEMS sensor may be rechargeable. Recharging of the energy storage device may occur at the surface before the active MEMS sensor is introduced into the wellbore. Recharging may also occur as the active MEMS sensor passes through the wellbore. For example, the energy storage device may be chargeable inductively and one or more inductive chargers may be disposed within the wellbore to charge the energy storage device when the active MEMS sensor is in proximity to the one or more inductive chargers. Such an inductive charger may be installed in the wellbore, for example as part of a downhole tool string, or may be lowered into the wellbore. The active MEMS sensor may also include both an energy storage device and an energy generating device such that the energy storage device is charged by the energy generating device.

Energy generating devices generally convert one or more of chemical, thermal, or mechanical energy into electrical energy for use by the active MEMS sensor, including for storage in an energy storage device of the active MEMS sensor. Suitable energy generating devices include, but are not limited to, combustors, turbines, heat engines, photovoltaic cells, thermoelectric generators, and piezoelectric generators. Accordingly, energy generating devices may take advantage of various downhole conditions to generate electrical energy. For example, a turbine may be used to generate electricity from fluid flow around or through the active MEMS sensor, a thermoelectric generator may be used to generate electricity from temperature gradients along the wellbore, and a piezoelectric generator may be used to generate electricity from vibrations induced in the active MEMS sensor by fluid flow or equipment vibrations.

Although one or more of the embodiments disclosed herein may be disclosed with reference to a cementing operation or stimulation operation, upon viewing this disclosure one of skill in the art will appreciate that the wellbore servicing systems and/or the methods disclosed herein may be employed in the performance of various other wellbore servicing operations such as primary cementing, secondary cementing, or other sealant operation when stimulation embodiments are disclosed and such as stimulation operations when cementing embodiments are disclosed. As such, unless otherwise noted, although one or more of the embodiments disclosed herein may be disclosed with reference to a particular operation, the disclosure should not be construed as so-limited.

FIG. 6 is a flowchart of an embodiment of a method for using sensors (e.g., MEMS sensors optionally comprising an elastomer coating) at the surface of a wellsite. At block 600, sensors are selected based on the parameter(s) or other conditions to be determined or sensed for the wellbore servicing composition in surface wellbore operating equipment (e.g., as described for FIG. 5A and/or FIG. 5B) at the surface of a wellsite.

At block 602, a quantity of sensors (e.g., MEMS sensors optionally comprising an elastomer coating) is mixed with a wellbore servicing composition (e.g., a drilling fluid, a spacer fluid, a sealant (e.g. a wellbore servicing fluid comprising a cement slurry, hydraulic cement slurry, or a non-cementitious sealant), a fracturing fluid, a gravel pack fluid, a completion fluid, or combinations thereof). In embodiments, the sensors are added to the wellbore servicing composition by any methods known to those of skill in the art with the aid of this disclosure. For example, for a wellbore servicing composition formulated as a sealant (e.g. a wellbore servicing fluid comprising a cement slurry, hydraulic cement slurry, or a non-cementitious sealant), the sensors may be mixed with a dry material, mixed with one more liquid components (e.g., water or a non-aqueous fluid), or combinations thereof. The mixing may occur onsite, for example, sensors may be added into a surface mixer (e.g., a cement slurry mixer such as mixing tubs 150 and/or 152 of FIG. 5A, a gel blender 240 of FIG. 5B, a sand blender 242 of FIG. 5A), a conduit or other flowline at the surface of the wellsite, or combinations thereof. The sensors may be added directly to the mixer, may be added to one or more flowlines and subsequently fed to the mixer, may be added downstream of the mixer, or combinations thereof. In embodiments, sensors are added after a blending unit and slurry pump, for example, through a lateral by-pass. The sensors may be metered in and mixed at the wellsite, or may be pre-mixed into the wellbore servicing composition (or one or more components thereof) and subsequently transported to the wellsite. For example, the sensors may be dry mixed with dry cement and transported to the wellsite where a cement slurry is formed comprising the sensors. Alternatively or additionally, the sensors may be pre-mixed with one or more liquid components (e.g., mix water) and transported to the wellsite where a wellbore servicing composition is formed comprising the sensors. The properties of the wellbore composition or components thereof may be such that the sensors distributed or dispersed therein do not substantially settle or stratify during transport and/or placement.

At block 604, an interrogator of the wellbore servicing system 30, (e.g., an interrogator as described above for FIGS. 5A and/or 5B) interrogates the sensors in the wellbore servicing composition. The interrogator may be placed in communicative proximity (e.g., a distance of about 0.1 meter to about 10 meters) of one or more of the sensors. In an embodiment, the interrogator is attached to surface wellbore operating equipment. In embodiments, the interrogator may retrieve data regarding one or more parameters (e.g., a location, a condition of mixing, a density, a composition component concentration) sensed by the sensors (e.g., MEMS sensors). In embodiments, the interrogator may activate and receive data form one or more sensors (e.g., MEMS sensors) in the wellbore servicing composition at the surface of the wellsite (e.g., within surface wellbore operating equipment). The interrogator may communicate data to a computer (e.g., a controller 170 of FIG. 5A or a controller 370 of FIG. 5A) whereby data sensor position (e.g., location) may indicate a mixing condition (e.g., uniformity of mixing), a concentration of a component in the wellbore servicing composition, a density of the wellbore servicing composition, a dispersion of the sensors (e.g., MEMS sensors) in the wellbore servicing composition at the surface of the wellsite, or combinations thereof. The interrogator may comprise a mobile transceiver electromagnetically coupled with the sensors.

At block 606, the sensors (e.g., MEMS sensors) are activated to receive and/or transmit data via the signal from the interrogator. The interrogator activates and receives data from the sensors (e.g., by sending out an RF signal) while the wellbore servicing composition mixes and flows through the wellbore servicing system 30. Activation of the sensors may be accomplished by the techniques described hereinabove or known in the art with the aid of this disclosure. The interrogator receives data sensed by the sensors in the wellbore servicing composition, for example, while being mixed, while flowing from one surface wellbore operating equipment to another, while flowing through conduit 190 during placement into the wellbore, or combinations thereof. The data sensed by the sensors may comprise a location of the sensors within the wellbore servicing composition, a condition of mixing, a density, a concentration of a component (e.g., of the wellbore servicing composition), a dispersion of the sensors (e.g., MEMS sensors) in the wellbore servicing composition at the surface of the wellsite, or combinations thereof. In embodiments of a method, the interrogator may be integrated with a radio-frequency (RF) energy source and the sensors may be passively energized via an FT antenna which picks up energy from the RF energy source, and the RF energy source may comprise frequencies of 125 kHz, 915 MHz, 13.5 MHz, 2.4 GHz, or combinations thereof. In an embodiment of a method, the sensors may comprise a radio frequency identification (RFID) tag.

At block 608, the interrogator communicates the data to one or more computer components (e.g., memory and/or microprocessor), for example, located within the interrogator at the surface or otherwise associated with the interrogator (e.g., via wired or wireless communication with a computer (e.g., controller 170 of FIG. 5A, controller 370 of FIG. 5B) configured to control the interrogator and to determine a parameter of the wellbore servicing composition). The data may be used locally or remotely from the interrogator to determine a parameter, (e.g., a location of each sensor in a wellbore servicing composition (e.g., MEMS sensor optionally comprising an elastomer coating), a dispersion of the sensors (e.g., MEMS sensors) in the wellbore servicing composition, a temperature, a pressure, a swelling or expansion of an elastomer coating of the MEMS sensor in response to contact with a hydrocarbon or water), and correlate the determined parameter(s) to evaluate a mixing condition (e.g., the sensor locations, a concentration of a component, a density, a dispersion of the sensors (e.g., MEMS sensors) in the wellbore servicing composition at the surface of the wellsite, or combinations thereof of the wellbore servicing composition (e.g., a drilling fluid, a spacer fluid, a sealant (e.g. cement slurry), a fracturing fluid, a gravel pack fluid, a completion fluid, or combinations thereof) and/or the sensors therein. If the determined parameter(s) indicate the wellbore servicing composition comprises suitable mixing (e.g., the sensors are adequately dispersed in the wellbore servicing composition), suitable concentrations, suitable density, etc., which makes the composition suitable for use in the wellbore, then the wellbore servicing composition may be suitable for placement in a wellbore (e.g., pumping via conduit 190 of FIG. 5A or pumping via flowline 158 of FIG. 5A). If the determined parameter(s) indicate the wellbore servicing composition is not suitable for use in the wellbore, the disclosed method and system allow a correction (e.g., an adjustment) of the wellbore servicing composition before placement into the wellbore. For example, parameters including a component concentration of the wellbore servicing composition, a condition of surface wellbore operating equipment (e.g., a mixing condition of a bulk mixer of the wellbore servicing system 30), a uniformity of mixing (e.g., as indicated by the location of one or more of sensors (e.g., a dispersion) in the wellbore servicing composition), a density (e.g., of a component of the wellbore servicing composition and/or the wellbore servicing composition), or combinations thereof, may be adjusted at the surface of the wellsite (e.g., recycling a non-conforming composition back to a mixer, e.g., mixing tubs 150 and/or 152 of FIG. 5A or blenders 240 and/or 242 of FIG. 5A) before placing the wellbore servicing composition into a wellbore.

The method steps of blocks 604, 606, and 608 may be repeated until a parameter of the wellbore servicing composition is suitable for placing the wellbore servicing composition in a wellbore (e.g., pumping via conduit 190 of FIG. 5A or pumping via flowline 158 of FIG. 5A). As such, real-time monitoring of a parameter of the wellbore servicing composition comprising the sensors (e.g., MEMS sensors optionally comprising an elastomer coating) at the surface of a wellsite may be used to control the design (e.g., uniformly mix) of the wellbore servicing composition for use in the wellbore.

At block 610, the wellbore servicing composition (e.g., a drilling fluid, a spacer fluid, a sealant (e.g. a wellbore servicing fluid comprising a cement slurry, hydraulic cement slurry, or a non-cementitious sealant), a fracturing fluid, a gravel pack fluid, or a completion fluid) comprising the sensors is then pumped into the wellbore (e.g., pumping via conduit 190 of FIG. 5A or pumping via flowline 158 of FIG. 5A). The composition may be placed downhole as part of a wellbore operation such as stimulating, primary cementing, secondary cementing, or other sealant operation as described in herein. The sensors of the wellbore servicing composition may be interrogated in conduit 190 (e.g., at portions of the conduit 190 of FIG. 5A or flowline 158 of FIG. 5A at the surface of the wellsite, at portions of the conduit 190 of FIG. 5B or flowline 158 of FIG. 5A below the surface, or both), and during placement of the composition in the wellbore, as described hereinabove. In an embodiment, the wellbore servicing composition comprises a wellbore servicing fluid which comprises a hydraulic cement slurry or a non-cementitious sealant, and additionally, the cement slurry may be placed in a wellbore (e.g., pumping via conduit 190 of FIG. 5A or pumping via flowline 158 of FIG. 5A) in a subterranean formation, wherein the cement slurry is pumped down an inside of a casing and flows out of the casing and into an annulus between the casing and the subterranean formation.

The exemplary wellbore servicing compositions disclosed herein may directly or indirectly affect one or more components or pieces of equipment associated with the preparation, delivery, recapture, recycling, reuse, and/or disposal of the disclosed wellbore servicing compositions. For example, the disclosed wellbore servicing compositions may directly or indirectly affect one or more mixers, related mixing equipment, mud pits, storage facilities or units, composition separators, heat exchangers, sensors, gauges, pumps, compressors, and the like used generate, store, monitor, regulate, and/or recondition the exemplary wellbore servicing compositions. The disclosed wellbore servicing compositions may also directly or indirectly affect any transport or delivery equipment used to convey the wellbore servicing compositions to a wellsite or downhole such as, for example, any transport vessels, conduits, pipelines, trucks, tubulars, and/or pipes used to compositionally move the wellbore servicing compositions from one location to another, any pumps, compressors, or motors (e.g., topside or downhole) used to drive the wellbore servicing compositions into motion, any valves or related joints used to regulate the pressure or flow rate of the wellbore servicing compositions, and any sensors (i.e., pressure and temperature), gauges, and/or combinations thereof, and the like. The disclosed wellbore servicing compositions may also directly or indirectly affect the various downhole equipment and tools that may come into contact with the cement compositions/additives such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

The wellbore servicing compositions (e.g., a cementitious or a non-cementitious resilient sealant, as discussed above) and MEMS sensors also include various advantages. For example, for embodiments comprising an elastomer coating, the elastomer coating of the sensors can protect and maintain the integrity of the sensors in the wellbore servicing composition due to the resilient nature of elastomers while also functioning as a part of the sensor (e.g., expanding, swelling, or compressing to indicate a change in one or more of the parameters disclosed hereinabove). Moreover, a composition can optionally have one or two mechanisms of resilience: i) resilience in the elastomer coating of the elastomer-coated sensors, and optionally, ii) resilience in the wellbore servicing composition itself (e.g., a foamed and/or polymeric sealing composition). Additionally, the use of non-silicon based sensors as described hereinabove allows for the use of MEMS sensors in thicker compositions and/or in scenarios where the distance between a communication tool (e.g., the interrogator disclosed herein) and the MEMS sensors is such that other sensor types may not be able to communicate information.

While various embodiments of the methods have been shown and described, modifications thereof can be made by one skilled in the art without departing from the spirit and teachings of the present disclosure. The embodiments described herein are exemplary only, and are not intended to be limiting. Many variations and modifications of the methods disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art to the present disclosure, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method comprising:

mixing a wellbore servicing composition comprising a plurality of Micro-Electro-Mechanical System (MEMS) sensors in surface wellbore operating equipment at the surface of a wellsite; and retrieving data at the surface wellbore operating equipment from a first MEMS sensor of the plurality of MEMS sensors, wherein the data comprises a unique identifier corresponding to the first MEMS sensor.

2. The method of claim 1, further comprising:

injecting the wellbore servicing composition into a wellbore.

3. The method of claim 1, further comprising:

determining the location of the first MEMS sensor based, at least in part, on the unique identifier.

4. The method of claim 3, wherein the first MEMS sensor comprises a self-locating system, and wherein the location of the first MEMS sensor is determined, at least in part, by positional data provided by the self-locating system.

5. The method of claim 3, further comprising:

receiving the unique identifier at downhole equipment, wherein the location of the first MEMS sensor is based, at least in part, on the location of the downhole equipment and on when the downhole equipment receives the unique identifier.

6. The method of claim 1, wherein the data further comprises one or more sensor readings.

7. The method of claim 1, wherein the plurality of MEMS sensors are active MEMS sensors.

8. The method of claim 7, further comprising:

transmitting the data from the first MEMS sensor to the surface wellbore operating equipment via one or more second MEMS sensors of the plurality of active MEMS sensors.

9. The method of claim 7, further comprising:

transmitting the data from the first active MEMS sensor to the surface wellbore operating equipment via at least one of a downhole device and a surface device.

10. The method of claim 7, wherein the first MEMS sensor comprises an on-board power source, the on-board power source further comprising at least one of an energy storage device and an energy generation device.

11. The method of claim 10, wherein the on-board power source comprises an energy storage device, and wherein the energy storage device is rechargeable and the method further comprises recharging the energy storage device with an inductive charging device.

12. A wellbore servicing system comprising:

surface wellbore operating equipment placed at a surface of a wellsite including a wellbore; and a wellbore servicing composition comprising a plurality of Micro-Electro-Mechanical System (MEMS) sensors, wherein the wellbore servicing composition is located in one or more of the surface wellbore operating equipment and the wellbore, wherein a first MEMS sensor of the plurality of MEMS sensors is configured to send data to the surface wellbore operating equipment, and wherein the data comprises a unique identifier corresponding to the first MEMS sensor.

13. The wellbore servicing system of claim 12, wherein the first MEMS sensor comprises a self-locating system configured to provide positional data of the first MEMS sensor.

14. The wellbore servicing system of claim 12, further comprising:

a locating device disposed in at least one of the surface wellbore equipment and the wellbore configured to receive the unique identifier from the first MEMS and to determine the location of the first MEMS at the time of receiving the unique identifier.

15. The wellbore servicing system of claim 12, wherein the data further comprises one or more sensor readings.

16. The wellbore servicing system of claim 12, wherein the plurality of MEMS sensors are active MEMS sensors.

17. The wellbore servicing system of claim 15, wherein one or more second MEMS sensors of the plurality of MEMS sensors are configured to transmit the data between the first MEMS sensor and the surface wellbore operating equipment.

18. The wellbore servicing system of claim 15, further comprising at least one of a downhole device and a surface device, wherein the at least one of the downhole device and the surface device are configured to transmit data between the first MEMS sensor and the surface wellbore operating equipment.

19. The wellbore servicing system of claim 15, wherein the first MEMS sensor comprises an on-board power source, the on-board power source further comprising at least one of an energy storage device and an energy generation device.

20. The wellbore servicing system of claim 18, further comprising:

an inductive charger disposed in one of the surface wellbore operating equipment and the wellbore, wherein the first MEMS sensor comprises an energy storage device, and wherein the energy storage device is rechargeable by the inductive charger.

* * * * *